US005447133A

United States Patent [19]

Kamio et al.

[11] Patent Number: 5,447,133

[45] Date of Patent: Sep. 5, 1995

[54] THROTTLE CONTROL APPARATUS FOR AN INTERNAL COMBUSTION ENGINE

[75] Inventors: Shigeru Kamio, Nagoya; Hitoshi Tasaka, Chiryu; Mitsuo Hara, Aichi; Masashi Kiyono, Anjo, all of Japan

[73] Assignee: Nippondenso Co., Ltd., Kariya, Japan

[21] Appl. No.: 139,709

[22] Filed: Oct. 22, 1993

[30] Foreign Application Priority Data

Oct. 23, 1992 [JP] Japan ..... 4-285922
Jun. 14, 1993 [JP] Japan ..... 5-142178

[51] Int. Cl.[6] ..... F02D 7/00

[52] U.S. Cl. ..... 123/396; 123/198 F; 123/399; 123/400

[58] Field of Search ..... 123/396, 399, 400, 198 F

[56] References Cited

U.S. PATENT DOCUMENTS 5,060,613 10/1991 Lieberoth-Leden et al. ..... 123/399
5,065,722 11/1991 Huber et al. ..... 123/396
5,172,667 12/1992 Spiegel ..... 123/396

FOREIGN PATENT DOCUMENTS 60-159346 8/1985 Japan .
62-35039 2/1987 Japan .
2-37245 3/1990 Japan .

*Primary Examiner*—Noah P. Kamen
*Attorney, Agent, or Firm*—Cushman, Darby & Cushman

[57] ABSTRACT

A throttle control apparatus includes an electrical drive unit for electrically driving a throttle of an internal combustion engine and a mechanical drive unit for driving the throttle through the operation of an accelerator by a driver. In the case where an abnormality is generated in the electrical drive unit, the driving of the throttle by the electrical drive unit is interrupted and the throttle is thereinstead driven by the mechanical drive unit. The mechanical drive unit is provided with a throttle opening angle control member. The throttle control apparatus further includes a torque control unit for suppressing an increase in output torque of the internal combustion engine in the case where a throttle opening angle is increased in the direction of an opening angle set by the throttle opening angle control member when the driving of the throttle by the electrical drive unit is interrupted.

30 Claims, 31 Drawing Sheets

FIG. 22

| Nfc | CYLINDERS TO BE SUBJECTED TO FUEL CUT | | | | | |
|---|---|---|---|---|---|---|
| 0 | 1 | 2 | 3 | 4 | 5 | 6 |
| 1 | ① | 2 | 3 | 4 | 5 | 6 |
| 2 | ① | 2 | 3 | ④ | 5 | 6 |
| 3 | ① | 2 | ③ | 4 | ⑤ | 6 |
| 4 | ① | 2 | ③ | ④ | 5 | ⑥ |
| 5 | ① | ② | ③ | ④ | ⑤ | 6 |
| 6 | ① | ② | ③ | ④ | ⑤ | ⑥ |

THROTTLE CONTROL APPARATUS FOR AN INTERNAL COMBUSTION ENGINE

BACKGROUND OF THE INVENTION

The present invention relates to a throttle control apparatus for an internal combustion engine, and more particularly to a throttle control apparatus for an internal combustion engine in which the opening angle of a throttle valve is electrically controlled by a motor or the like thus preventing a sudden increase in engine torque caused by a throttle valve opening operation at the time of generation of an abnormality in the control system.

In recent years, many throttle control apparatuses have been proposed which electrically control the opening angle of a throttle valve of an internal combustion engine by a motor or the like. The characteristic of the throttle opening angle for the amount of accelerator operation can be set arbitrarily, and these control apparatuses have an advantage that it is possible to accurately cope with the running condition of a vehicle such as acceleration request. In contrast with a general system in which a throttle valve is mechanically coupled with an accelerator pedal, such throttle control apparatuses may possibly drive a throttle valve in an opening direction irrespective of the amount of accelerator operation when an abnormality is generated in a control system. In this case, there is an inconvenience in that an engine torque is suddenly increased against the driver's intent, thereby producing an uncomfortable feelng in the driver.

Throttle control apparatuses disclosed by JP-A-62-35039 and JP-A-60-159346 are known as throttle control apparatuses for an internal combustion engine capable of coping with the abnormality of a throttle control system.

In the throttle control apparatus disclosed by the JP-A-62-35039, when an abnormality is generated in a throttle control system in a state in which an engine rotation speed exceeds 2000 rpm, fuel is cut-off for each cylinder in an off-and-on way to limit the engine rotation speed to a value not higher than 2000 rpm, thereby preventing a sudden increase in engine output torque.

On the other hand, the throttle control apparatus disclosed by the JP-A-60-159346 copes with an abnormality in a throttle control system as follows. For example, when a throttle valve is opened notwithstanding that an accelerator is not operated, it is assumed that an abnormality is generated in a control system. As a result, the operation of three of four cylinders of an internal combustion engine is ceased (or put out of operation) by the fuel cut-off, thereby suppressing an engine output torque. When the accelerator is operated, lone cylinder being subjected to fuel cut-off is recovered, thereby ensuring sufficient engine torque to the extent necessary to continue the travel of the vehicle.

In the two kinds of throttle control apparatuses as mentioned above, a sudden increase in engine torque is suppressed by fuel cut-off when an abnormality is generated in a throttle control system. However, since the fuel cut-off is carried out by a fuel control system similar to the throttle control system, the possibility exists that the fuel would not be carried out due to the influence of the abnormality of the throttle control system. Therefore, the fuel cut-off is not sufficiently reliable as a countermeasure when an abnormality is generated.

SUMMARY OF THE INVENTION

An object of the present invention is to provide a throttle control apparatus for an internal combustion engine which can suppress an increase in engine torque against an driver's intention at the time of generation of an abnormality of a throttle control system and in its turn can improve the feeling of accelerator operation without giving the sense of unfitness to the driver.

A throttle control apparatus according to the present invention includes an electrical drive unit for electrically driving a throttle of an internal combustion engine and a mechanical drive unit for driving the throttle through the operation of an accelerator by a driver. In the case where an abnormality is generated in the electrical drive unit, the driving of the throttle by the electrical drive unit is interrupted and the throttle is there instead driven by the mechanical drive unit. The mechanical drive unit is provided with a throttle opening angle control member. The throttle control apparatus further includes a torque control unit for suppressing an increase in output torque of the internal combustion engine in the case where a throttle opening angle is increased in the direction of an opening angle set by the throttle opening angle control member when the driving of the throttle by the electrical drive unit is interrupted.

BRIEF DESCRIPTION OF THE DRAWINGS

FIG. 22 is an explanatory diagram showing a map for determining cylinders to be subjected to the cessation of fuel injection from the number of cylinders to be subjected to fuel cut-off in the throttle control apparatus for an internal combustion engine according to an embodiment of the present invention;

FIG. 27 is a time chart of each signal at the time an ignition switch is turned on;

DESCRIPTION OF THE PREFERRED EMBODIMENTS

Figure 1:
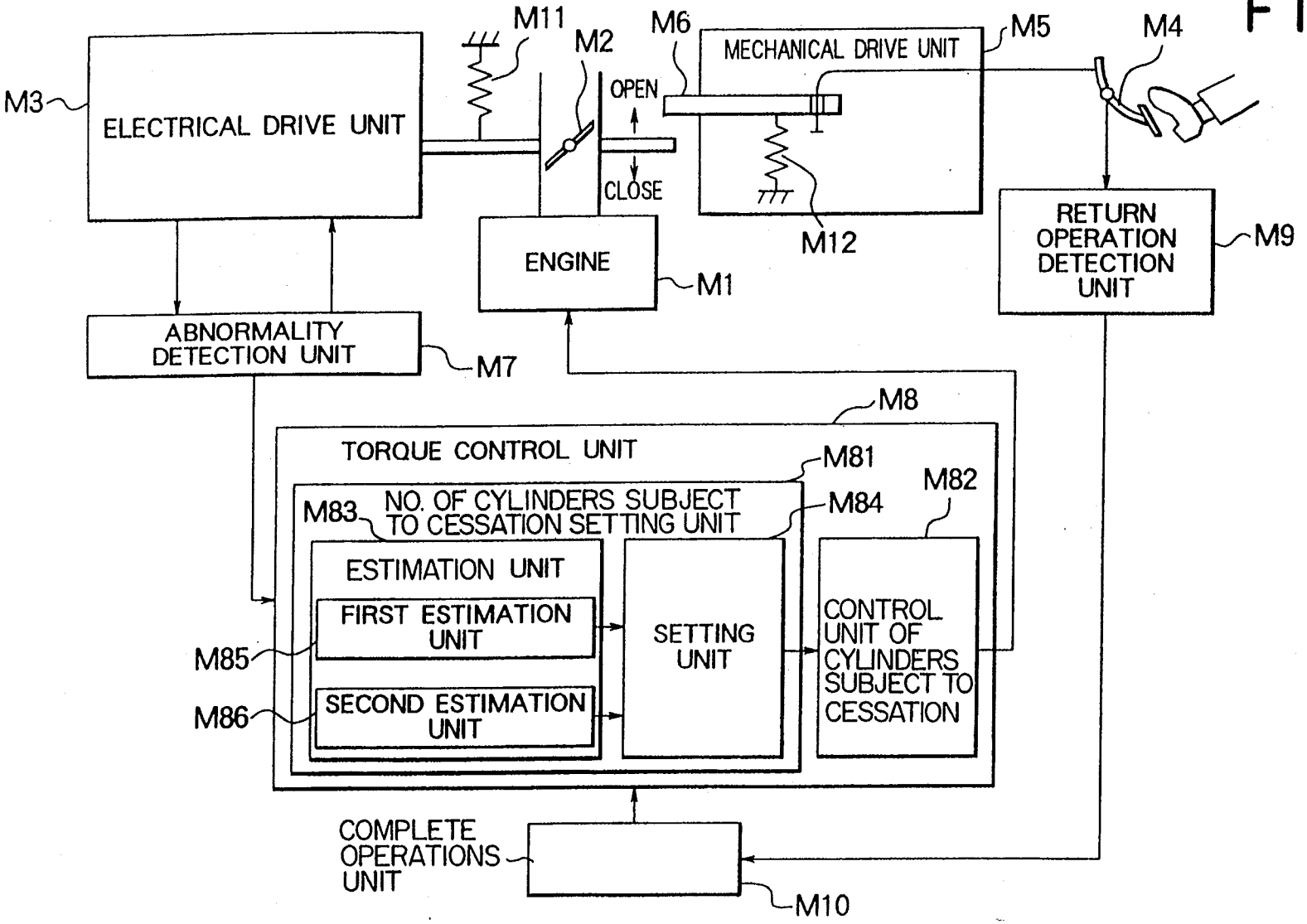
FIG. 1 is a block diagram conceptually showing the contents of a throttle control apparatus for an internal combustion engine according to an embodiment of the present invention.

FIG. 1 shows a schematic diagram of an embodiment of a throttle control apparatus for an internal combustion engine according to the present invention. The throttle control apparatus of the embodiment shown in FIG. 1 includes an electrical drive unit M3 for electrically driving a throttle M2 of an internal combustion engine M1 and a mechanical drive unit M5 for driving the throttle M2 in a mechanically interlocking manner with an accelerator M4 operated by a driver. The mechanical drive unit M5 has an opening angle control member M6 which is moved interlocking with the accelerator M4 to limit the opening angle of the throttle M2 at a position on a closed side as compared with a throttle opening angle given by the electrical drive unit M3. The throttle control apparatus further includes an abnormality detection unit M7 for detecting an abnormality of the electrical drive unit M3 to interrupt the driving of the throttle M2 by the electrical drive unit M3, and a torque control unit M8 for suppressing an increase in output torque of the internal combustion engine M1 in the case where the opening angle of the throttle M2 is increased in the direction of an angle set by the throttle opening angle control member M6 from an opening angle given by the electrical drive unit M3 when the driving of the throttle M2 by the electrical drive unit M3 is interrupted.

In the embodiment of the present invention, there are further provided a unit M9 for detecting a return operation of the accelerator M4 after the detection of an abnormality of the electrical drive unit M3 and a finishing unit M10 for finishing the operation of suppression of the increase in output torque of the internal combustion engine M1 when the return operation of the accelerator M4 is detected.

In the embodiment of the present invention, the torque control unit M8 performs the operation of suppression of the increase in output torque of the internal combustion engine M1 by ceasing the combustion of a cylinder of the internal combustion engine M1. The torque control unit M8 includes a number of cylinders subject to cessation setting unit M81 for setting the number of cylinders to be subjected to combustion cessation in accordance with the quantity of increase in output torque of the internal combustion engine M1 before and after the detection of the abnormality of the electrical drive unit M3, and a cessation cylinder control unit M82 for temporarily ceasing the combustion of cylinders equal in number to the set number of cylinders to be subjected to combustion cessation.

In the embodiment of the present invention, the cessation cylinder number setting unit M81 includes an estimation unit M83 for estimating a first output torque value at the time of the detection of an abnormality of the electrical drive unit M3 and a second output torque value corresponding to an opening angle controlled by the opening angle control member M6, and a setting unit M84 for determining the quantity of increase in torque from the first and second output torque values estimated by the estimation unit M83 to set the number of cylinders to be subjected to combustion cessation in accordance with the quantity of increase in torque.

In the embodiment of the present invention, the estimation unit M83 has a first estimation unit M85 for estimating the first output torque value on the basis of the opening angle of the throttle M2 and the rotation speed of the internal combustion engine M1 at the time of detection of an abnormality of the electrical drive unit M3, and a second estimation unit M86 for estimating the second output torque value on the basis of the amount of operation of the accelerator M2 and the rotation speed of the internal combustion engine M1 after the detection of an abnormality of the electrical drive unit M3.

According to the throttle control apparatus of this embodiment, an increase in engine torque against a driver's intention at the time of generation of an abnormality of the electrical drive unit M3 is suppressed. Therefore, it becomes possible to continue the running of a vehicle without adjusting the amount of operation of the accelerator M2 again. Also, with the provision of the complete operations unit M10, the torque increase suppressing operation is stopped in the case where the driver performs an operation for returning the accelerator M4 after the abnormality of the electrical drive unit M3 has been detected. Therefore, it is possible to avoid the generation of an oscillation of the internal combustion engine M1 due to the cessation of combustion of unnecessary or specified cylinders.

In the throttle control apparatus of the embodiment of the present invention, the electrical drive unit M3 is provided with an opening direction energizing device M11 for energizing the throttle M2 in a direction in which the throttle M2 is opened.

In the throttle control apparatus of the embodiment of the present invention, the mechanical drive unit M3 is provided with a closing direction energizing device M12 for energizing the opening angle control member M6 by an energizing force stronger than that of the opening direction energizing device M11 and in a direction in which the throttle M2 is closed.

In the following, the throttle control apparatus of the embodiment of the present invention will be further explained in detail.

Figure 2:
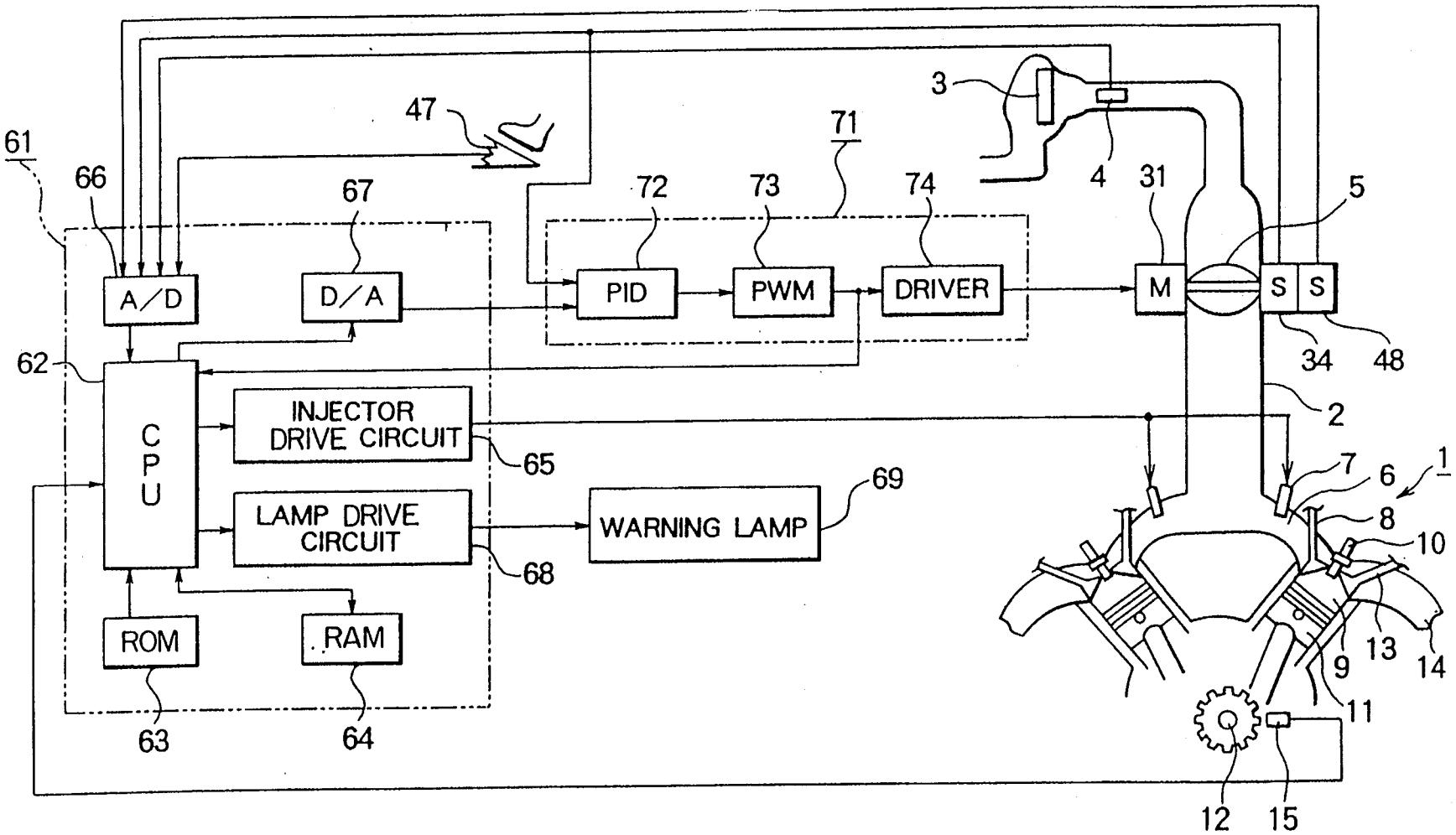
FIG. 2 is a diagram schematically showing the construction of the throttle control apparatus for an internal combustion engine according to an embodiment of the present invention.
Figure 3:
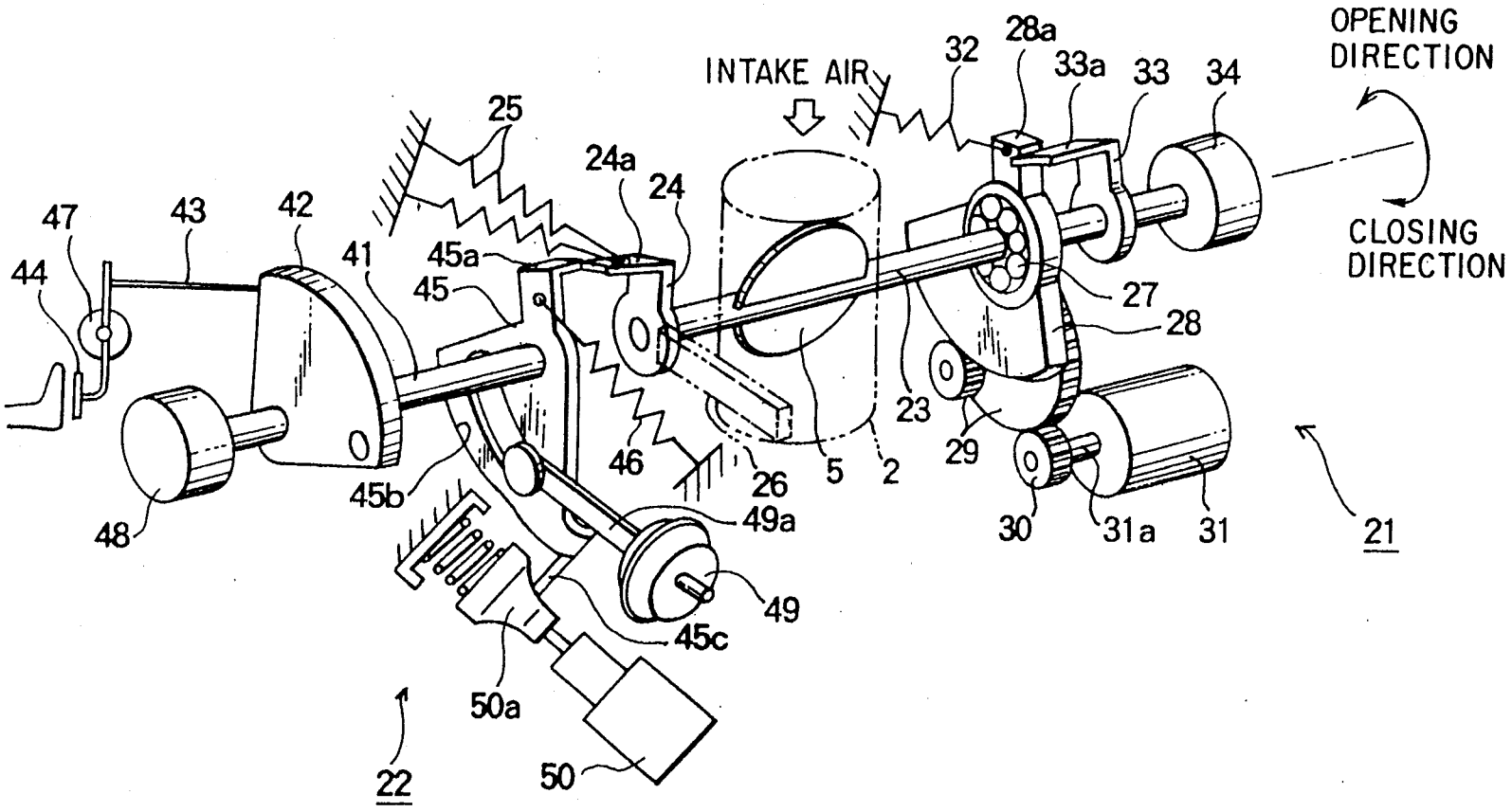
FIG. 3 is a perspective view showing the periphery of a throttle valve to which the throttle control apparatus an internal combustion engine according to an embodiment of the present invention is applied.

FIG. 2 is a diagram showing the schematic construction of the throttle control apparatus for an internal combustion engine according to the embodiment of the present invention, and FIG. 3 is a perspective view showing the periphery of a throttle valve to which the throttle control apparatus for an internal combustion engine according to the embodiment of the present invention is applied.

First, explanation will be made of the-16 schematic construction of the throttle control apparatus of the first embodiment of the present invention.

As shown in FIG. 2, an internal combustion engine 1 is constructed as a V-type 6-cylinder 4-cycle internal combustion engine. An air cleaner 3 is provided on the upperstream side of an intake path 2 of the internal combustion engine 1. An air flow meter 4 for detecting the amount of intake air is provided on the downstream side of the air cleaner 3. A throttle valve 5 is provided on the downstream side of the intake path 2 lower than the air flow meter 4. The amount of intake air supplied to the internal combustion engine 1 is adjusted in accordance with the opening/closing of the throttle valve 5. The intake path 2 is connected to each cylinder of the internal combustion engine 1 through an intake manifold 6. An intake air from the intake path 2 is distributively supplied to each cylinder through the intake manifold 6.

The intake manifold 6 includes an injector 7 corresponding to each cylinder. Fuel injected from the injector 7 is supplied to each cylinder in a form mixed with the intake air. The fuel-air mixture is introduced into a combustion chamber 9 of each cylinder with the opening/closing of an intake valve 8 and is subjected to combustion by the ignition of an ignition plug 10. By a kinetic energy generated by the combustion of the fuel-air mixture, a piston 11 is depressed to apply a torque to a crank shaft 12. An exhaust gas after combustion is delivered to the exterior through an exhaust path 14 with the opening of an exhaust valve 13. A crank angle sensor 15 is provided at a position near to the crank shaft 12 to output a pulse signal at each crank angle 30°.

Next, the construction of the periphery of the throttle valve of the internal combustion engine having the above construction will be explained.

As shown in FIG. 3, the construction of the periphery of the throttle valve of the throttle control apparatus according to the present embodiment is generally divided into a motor drive mechanism 21 for electrically opening/closing the throttle valve 5 by a DC motor 31 and an accelerator interlocking mechanism 22 for mechanically opening/closing the throttle valve 5 in an interlocking manner with an accelerator operation.

First explaining the motor drive mechanism 21, a throttle shaft 23 transverses through the intake path 2. The throttle valve 5 is secured to the throttle shaft 23 in the intake path 2. The throttle valve 5 opens and closes the intake path 2 with the rotation of the throttle shaft 23 to adjust the amount of intake air. The direction of rotation of the throttle shaft 23 is defined as an opening direction when the throttle valve 5 opens the intake path 2 and as a closing direction when the throttle valve 5 closes the intake path 2. Opposite ends of the throttle shaft 23 protrude from the intake path 2 to the right and left (or in the right and left-18 directions in FIG. 3). A stopper lever 24 is secured to the left end of the throttle shaft 23. The stopper lever 24 is provided with an L-shaped bent portion 24*a*. Two valve springs 25 are coupled to the bent portion 24*a* to energize the throttle shaft 23 in the opening direction. Also, a fully-closed position stopper 26 is provided at a position near the bent portion 24*a*. When the throttle valve 5 is rotated up to a fully-closed position, the fully-closed position stopper 26 abuts against the bent portion 24*a* of the stopper lever 24 to control a further rotation.

A slave gear 28 having a quarter circular form is rotatably coupled to the right portion of the throttle shaft 23 through a bearing 27. The slave gear 28 engages with a driving gear 30 through a pair of large and small intermediate gears 29. The driving gear 30 is secured to an output shaft 31*a* of the DC motor 31. The DC motor 31 drives the slave gear 28 for rotation through the driving gear 30 and the intermediate gears 29 in the closing direction. A protrusion 28*a* is formed on one side of the slave gear 28 and a return spring 32 coupled to the protrusion 28*a* energizes the slave gear 28 in the opening direction always or in a direction reverse to the driving direction of the DC motor 31.

A stopper lever 33 is secured to the throttle shaft 23 on the right side of the slave gear 28. The stopper lever 33 is provided with an L-shaped bent portion 33*a*. The bent portion 33*a* is positioned on the closed side of the protrusion 28*a* of the slave gear 28. The bent portion 33*a* abuts against the protrusion 28*a* by the energization of the throttle shaft 23 by the valve springs 25 into rotation in the opening direction. Accordingly, when the DC motor 31 is actuated (or energized) to generate a torque, the slave gear 28 is rotated against the energizing forces of the return spring 32 and the valve springs 25 or in the closing direction so that the throttle valve 5 is driven for rotation in the closing direction together with the stopper lever 33 and the throttle shaft 23. When the actuation of the DC motor 5 is stopped, the throttle valve 5 is energized by the valve springs 25 in the opening direction and the slave gear 28 is energized in the opening direction by the return spring 32.

A throttle opening angle sensor 34 is provided on the right end of the throttle shaft 23. The opening angle sensor 34 outputs a voltage Vth corresponding to the opening angle of the throttle valve 5.

On the other hand, explaining the accelerator interlocking mechanism 22, a guard shaft 41 is rotatably supported on the left side of the throttle shaft 23 so that the guard shaft 41 is positioned on the same axis as the throttle shaft 23. An accelerator lever 42 secured to the guard shaft 41 is coupled to an accelerator pedal 44 of a vehicle through a control cable 43. A guard lever 45 is secured on the right end of the guard shaft 41. The guard lever 45 is energized in the closing direction always by virtue of a guard spring 46 coupled to one side of the guard lever 45. The energizing force of the guard spring 46 is set to be sufficiently strong as compared with the energizing force of the two valve springs 25. When the accelerator pedal 44 is depressed by a driver, the guard shaft 41 and the guard lever 45 are operated together with the accelerator lever 42 through the control cable 43 so that they are rotated in the opening direction against the energizing force of the guard spring 46.

The accelerator pedal 44 is provided with an accelerator position sensor 47. As will be mentioned later on, the throttle valve 5 is driven for opening/closing by the DC motor 31 on the basis of the amount Ap of accelerator operation detected by the accelerator position sensor 47. The characteristic of the throttle opening angle 0th at this time is such that the throttle opening angle approximately increases with the increase of the amount Ap of accelerator operation. Therefore, when-the accelerator operation is performed, the throttle valve 5 is driven by the DC motor 31 on one hand so that the valve is electrically opened/closed. On the other hand, the guard lever 45 is mechanically rotated by transmission through the control cable 43 in the same direction.

An L-shaped bent portion 45*a* is provided on one side of the guard lever 45. The bent portion 45*a* is positioned on the opened side of the bent portion 24*a* of the stopper lever 24. A predetermined amount of play is established between the bent portions 45*a* and 24*a*. This play is ensured always when the throttle shaft 23 and the guard shaft 41 are rotated in the same direction.

As will be mentioned later on, when an abnormality of a throttle control system or a valve lock is generated, the throttle valve 5 is rotationally operated in the opening direction by the energizing force of the valve springs 25 since the actuation of the DC motor 31 is stopped. At this time, the bent portion 24*a* of the stopper lever 24 abuts against the bent portion 45*a* of the guard lever 45 to control the further opening of the throttle valve 5 so that the opening angle of the throttle valve 5 is controlled to a value not larger than the rotating angle of the guard lever 45 (hereinafter referred to simply as "guard position"). And, when the guard shaft 41 is rotationally operated by the accelerator operation, as mentioned above, the stopper lever 24 is rotated together with the guard lever 45 in the same direction so that the throttle valve 5 is opened/closed. In other words, thereafter, the throttle valve 5 is mechanically opened/closed by the accelerator interlocking mechanism 22, thereby making it possible for the vehicle to continue traveling. A guard position sensor 48 is provided on the left end of the guard shaft 41 to detect a guard position Θmg.

An elongated hole 45*b* of a circular arc form centering around the guard shaft 41 is formed in the guard lever 45 and the tip of an operating rod 49 of a diaphragm actuator 49 is movably inserted in and along the elongated hole 45*b*. At the time of normal operation, the operating rod 49*a* of the diaphragm actuator 49 is held at an expanded condition, as shown in FIG. 3, so that the guard lever 45 is rotated in accordance with an accelerator operation while being allowed by the elongated hole 45*b*. At the time of cruise control operation, the operating rod 49*a* of the diaphragm actuator 49 is contracted to rotationally operate the guard lever 45 in the opening direction. Accordingly, since the guard position is changed greatly in the opening direction even if an accelerator operation is not performed, the throttle valve 5 is operated by the DC motor 31 in the opening direction, thereby making it possible to maintain a speed of travel set by the driver.

An engaging claw 45*c* formed integrally with the guard lever 45 engages with an operating rod 50*a* of a thermowax 50. The operating rod 50*a* of the thermowax 50 is expanded/contracted in accordance with the temperature of cooling water in the internal combustion engine. For example, when the cooling water temperature is high as it is after the completion of warm-up, the operating rod 50*a* is expanded as shown in FIG. 3 so that the guard lever 45 is rotated in the closing direction. Also, when the cooling water temperature is low as it is at the time of a cold start, the operating rod 50*a* is contracted so that the guard lever 45 is rotated in the opening direction. And, the throttle valve 5 is operated by the DC motor 31 in the opening direction in a manner similar to that at the time of cruise control travel as mentioned above, thereby enabling idle speed-up.

Next, the above-mentioned operation of the periphery of the throttle valve will be explained in a summarized form.

Figure 4:
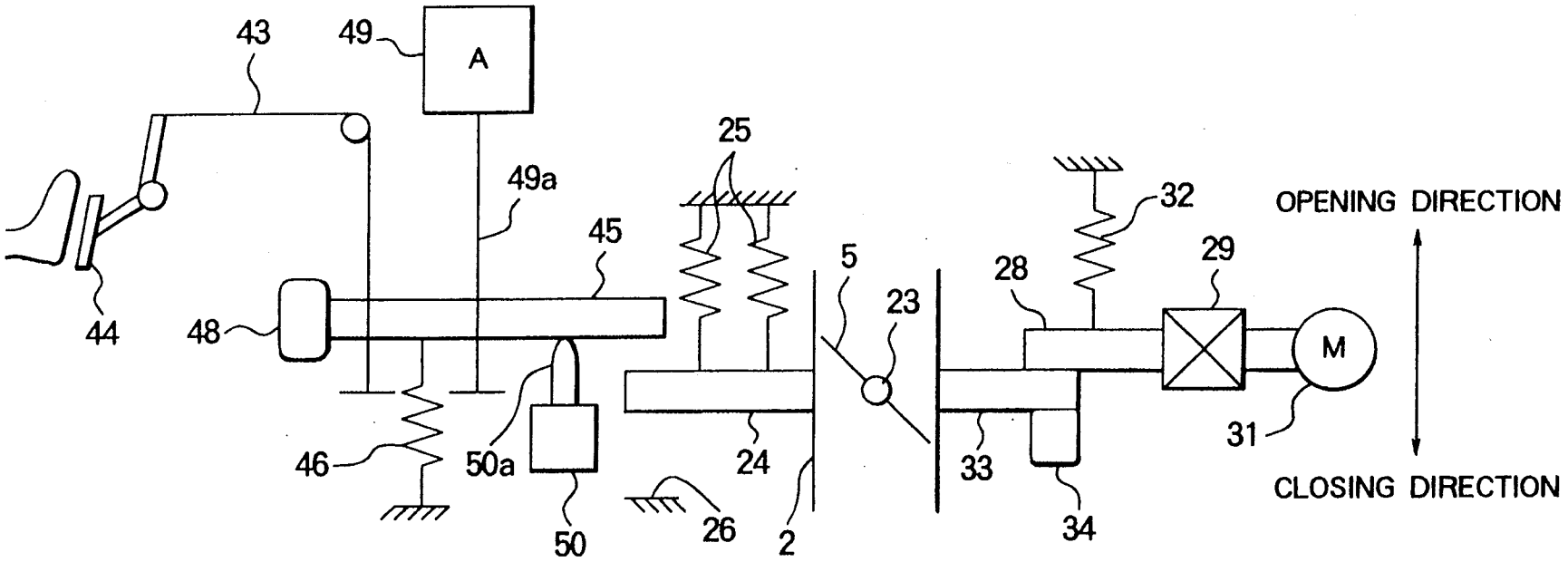
FIG. 4 is a schematic diagram for explaining the principle of operation of the periphery of the throttle valve to which the throttle control apparatus for an internal combustion engine according to an embodiment of the present invention is applied.

FIG. 4 is a diagram schematically showing the principle of operation of the periphery of the throttle valve to which the throttle control apparatus for internal combustion engine according to the embodiment of the present invention is applied. In FIG. 4, the opening direction of the throttle valve 5 is depicted in the upward direction and the closing direction is depicted in the downward direction thereof.

As shown in FIG. 4, the guard lever 45 is energized by the guard spring 46 in the closing direction. A guard position by the guard lever 45 is determined by the amount of operation of the accelerator pedal 44, the amount of displacement of the operating rod 49*a* of the diaphragm actuator 49 and the amount of displacement of the operating rod 50*a* of the thermowax 50. For example, when the accelerator pedal 44 is pushed by a driver, the guard lever 45 is operated in the opening direction against the energizing force of the guard spring 46 (or is pulled upward in FIG. 3) so that the guard position is changed in the opening direction.

Also, the throttle valve 5 in the opening direction is energized by the valve springs 25 and the DC-24 motor 31 is energized in the opening direction by the return spring 32. When the DC motor 31 drives the throttle valve 5 in the opening direction, the energizing forces of the valve springs and the return spring 32 act in a direction against the driving of the throttle valve 5 by the DC motor 31. Accordingly, the opening angle of the throttle valve 5 is determined by a balance between the energizing forces of the springs 25 and 32 and the torque of the DC motor 31. As the torque of the DC motor 31 is increased, the throttle valve 5 is closed. When the actuation of the DC motor 31 is stopped, the throttle valve 5 is energized in the opening direction by the valve springs 25 and the slave gear 28 is energized in the opening direction by the return spring 32.

Next, explanation will be made of the electrical construction of the throttle control apparatus of the present embodiment.

As shown in FIG. 2, an electronic control section 61 of the throttle control apparatus includes a CPU 62, a ROM 63, a RAM 64, an injector drive circuit 65, a lamp drive circuit 68, an A/D converter circuit 66 and a D/A converter circuit 67. In the ROM 63 various programs are stored for controlling the operation of the internal combustion engine 1, for example, a program for control of the opening angle of the throttle valve 5, a program for control of fuel injection from the injector 7, and so on. The CPU 62 performs processes in accordance with those programs. Also, the RAM 64 temporarily stores data for processes performed by the CPU 62.

The CPU 62 is input with a pulse signal from the crank angle sensor 15 and is further input with the amount of intake air Qa detected by the air flow meter 4, an output voltage Vth of the throttle opening angle sensor 34 (or a throttle opening angle Θth), the amount of accelerator operation Ap detected by the accelerator position sensor 47 and a guard position Θmg detected by the guard position sensor 48 after conversion thereof by the A/D converter circuit 66 into digital values.

The CPU 62 determines the amount of fuel injection presently requested by the internal combustion engine 1, for example, on the basis of an engine rotation speed Ne determined from the pulse signal of the crank angle sensor 15 and the amount of intake air Qa to output a control signal with a pulse width corresponding to the determined amount of fuel injection to the injector drive circuit 65. When an abnormality of the throttle control system or a valve lock is generated, as will be mentioned later on, the CPU 62 determines the number of cylinders Nfc to be subjected to fuel cut-off (0 to 6) to stop outputting the control signal to specified cylinders in accordance with the number of cylinders Nfc to be subjected to fuel cut-off. The injector drive circuit 65 actuates the injector 7 for only a time corresponding to the pulse width input from the CPU 62 so that the requested amount of fuel is injected. On the other hand, fuel injection is ceased for the specified cylinders to which the control signal from the CPU 62 is not input.

Also, the CPU 62 determines a throttle opening angle command value Θcmd as a target value for throttle opening angle control on the basis of the amount of accelerator operation Ap and the engine rotation speed Ne and further determines a throttle command voltage Θcmd corresponding to the throttle opening angle command value Θcmd.

When various abnormalities, which will be mentioned later on, are generated in connection with the throttle function of the internal combustion engine 1, the CPU 62 outputs a control signal to the lamp drive circuit 68 to light a warning lamp 69 provided at a driver's seat of the vehicle.

A DC motor drive circuit 71 of the throttle control apparatus includes a PID control circuit 72, a PWM (pulse width modulation) circuit 73 and a driver 74. The throttle command voltage Vcmd determined by the CPU 62 as mentioned above is converted by the D/A converter circuit 67 into an analog value which is in turn input to the PID control circuit 72. On the basis of the throttle command voltage Vcmd and the output voltage Vth of the throttle opening angle sensor 34, the PID control circuit 72 performs a proportional, integrating and differentiating operation for minimizing a deviation between both the voltages to determine the amount of control of the DC motor 31. The determined amount of control is input to the PWM circuit 73 which in turn converts the amount of control into a corresponding duty ratio signal. The driver 74 drives the DC motor 31 in accordance with the duty ratio signal to adjust the actual throttle opening angle Θth to a throttle opening angle command value Θcmd. The duty ratio signal of the PWM circuit 73 is also input to the CPU 62.

[Throttle Control Processing]

Next, a throttle control process performed by the CPU of the throttle control apparatus for an internal combustion engine having the above construction will be explained.

Figure 5:
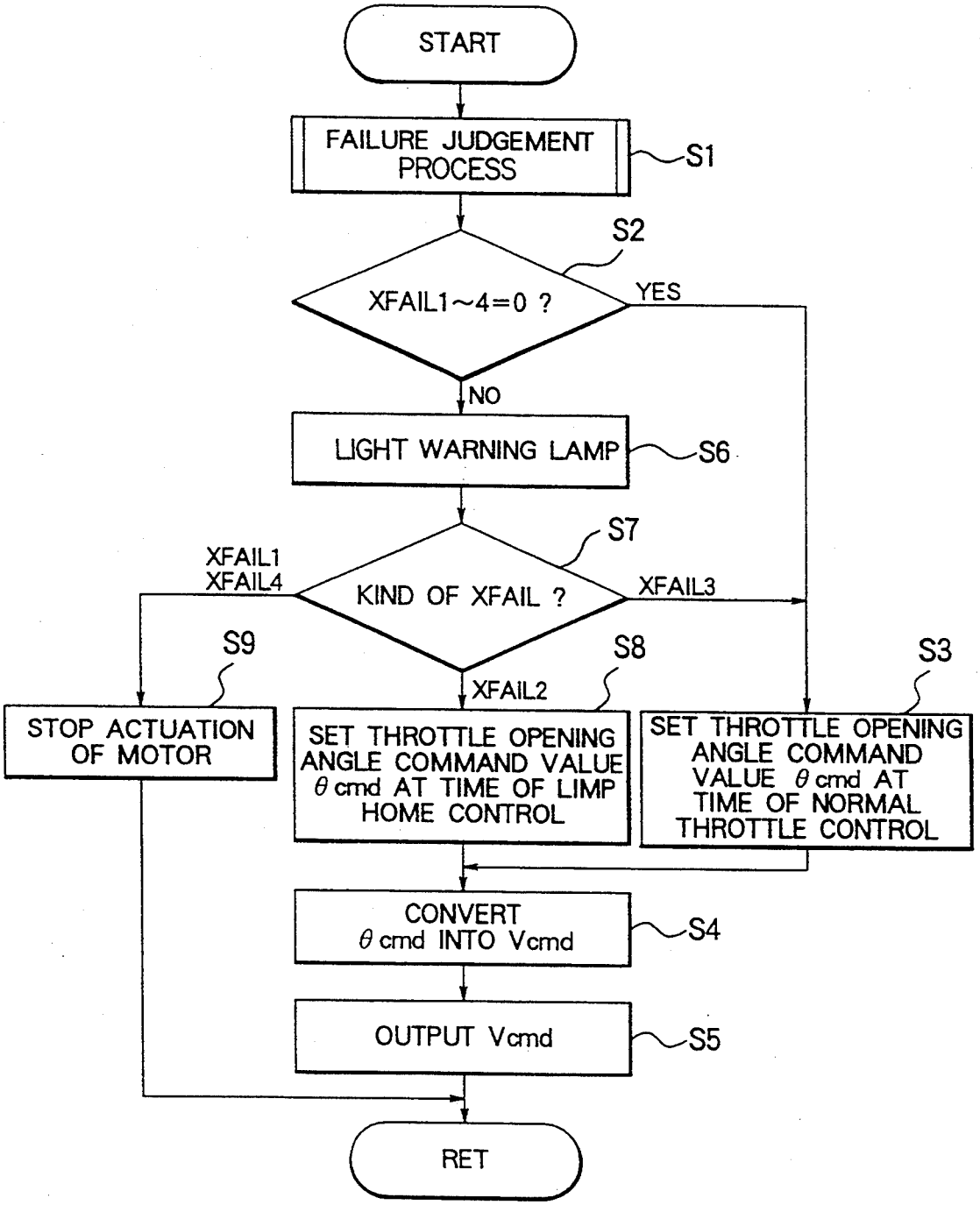
FIG. 5 is a flow chart showing a throttle control routine performed by a CPU of the throttle control apparatus for an internal combustion engine according to an embodiment of the present invention.
Figure 6:
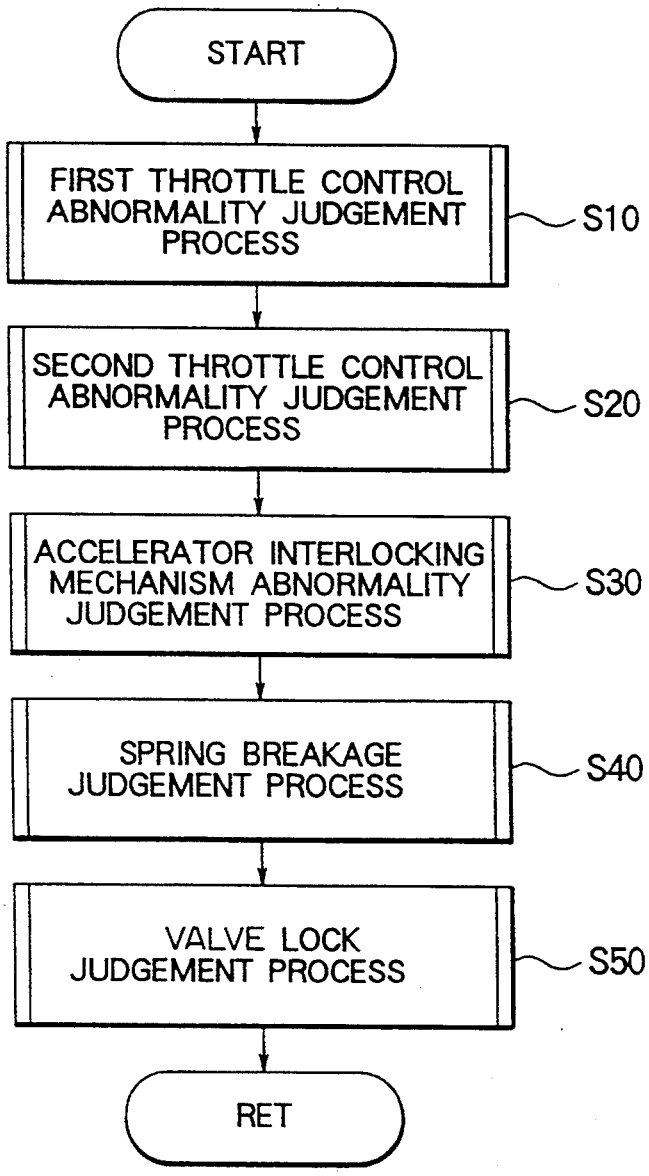
FIG. 6 is a flow chart showing a failure judgement routine performed by the CPU of the throttle control apparatus for an internal combustion engine according to an embodiment of the present invention.
Figure 7:
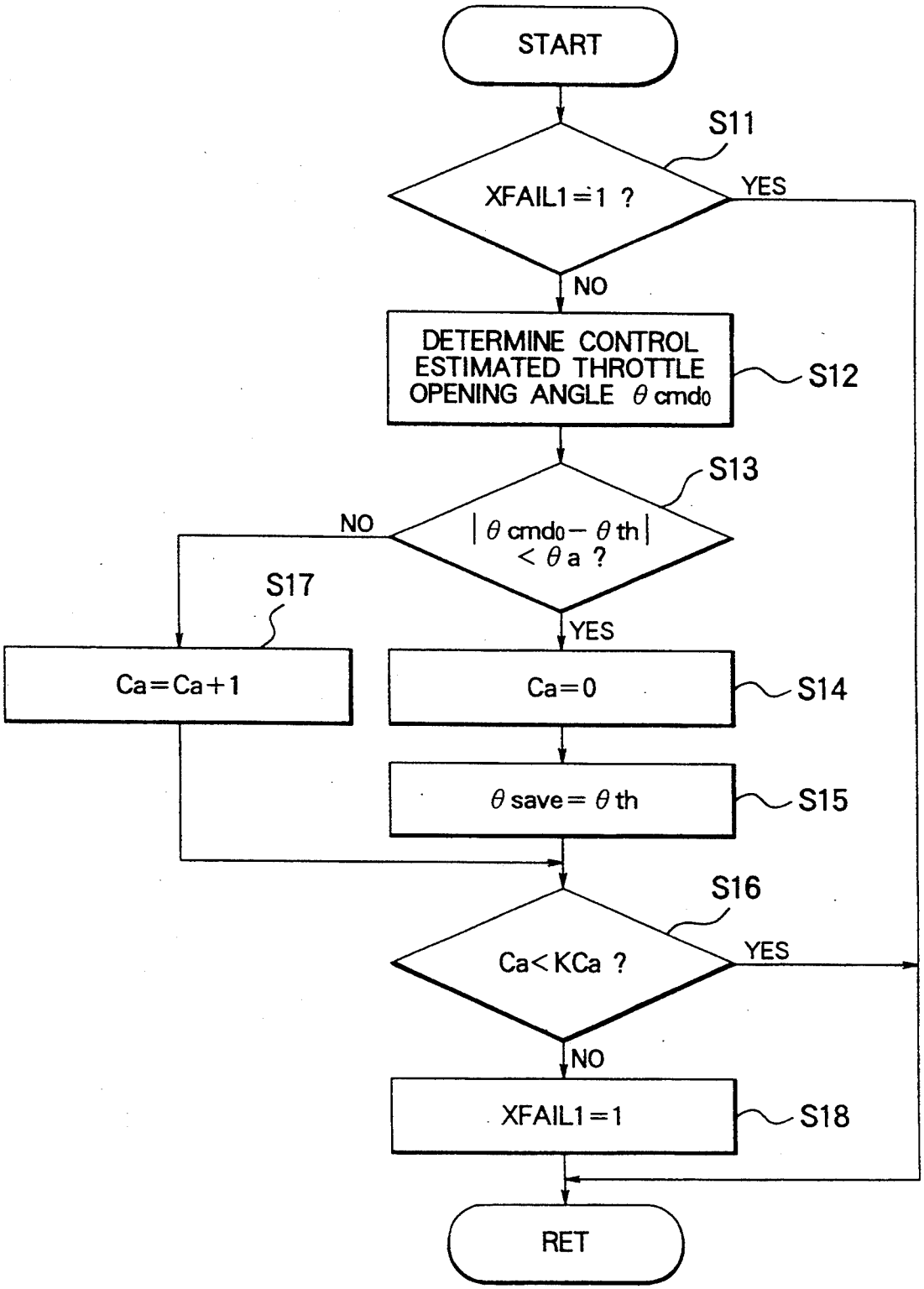
FIG. 7 is a flow chart showing a first throttle control system abnormality judgement routine performed by the CPU of the throttle control apparatus for an internal combustion engine according to an embodiment of the present invention.
Figure 8:
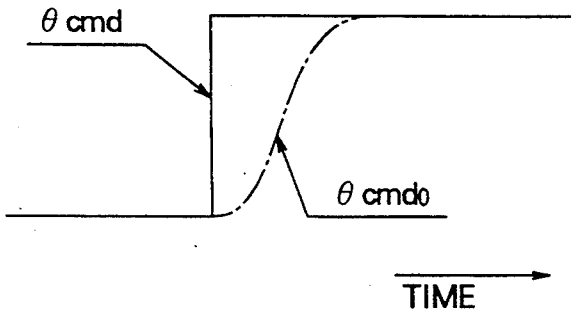
FIG. 8 is a diagram for explaining a control delay of the actual throttle opening angle for the throttle opening angle command value in the throttle control apparatus for an internal combustion engine according to an embodiment of the present invention.

FIG. 5 is a flow chart showing a throttle control routine performed by the CPU of the throttle control apparatus for an internal combustion engine according to the first embodiment of the present invention. FIG. 6 is a flow chart showing a failure judgement routine performed by the CPU of the throttle control apparatus for an internal combustion engine according to the first embodiment of the present invention. FIG. 7 is a flow chart showing a first throttle control system abnormality judgement routine performed by the CPU of the throttle control apparatus for an internal combustion engine according to the first embodiment of the present invention. FIG. 8 is a diagram for explaining a control delay of the actual throttle opening angle for the throttle opening angle command value in the throttle control apparatus for internal combustion engine according to the embodiment of the present invention.

Figure 9:
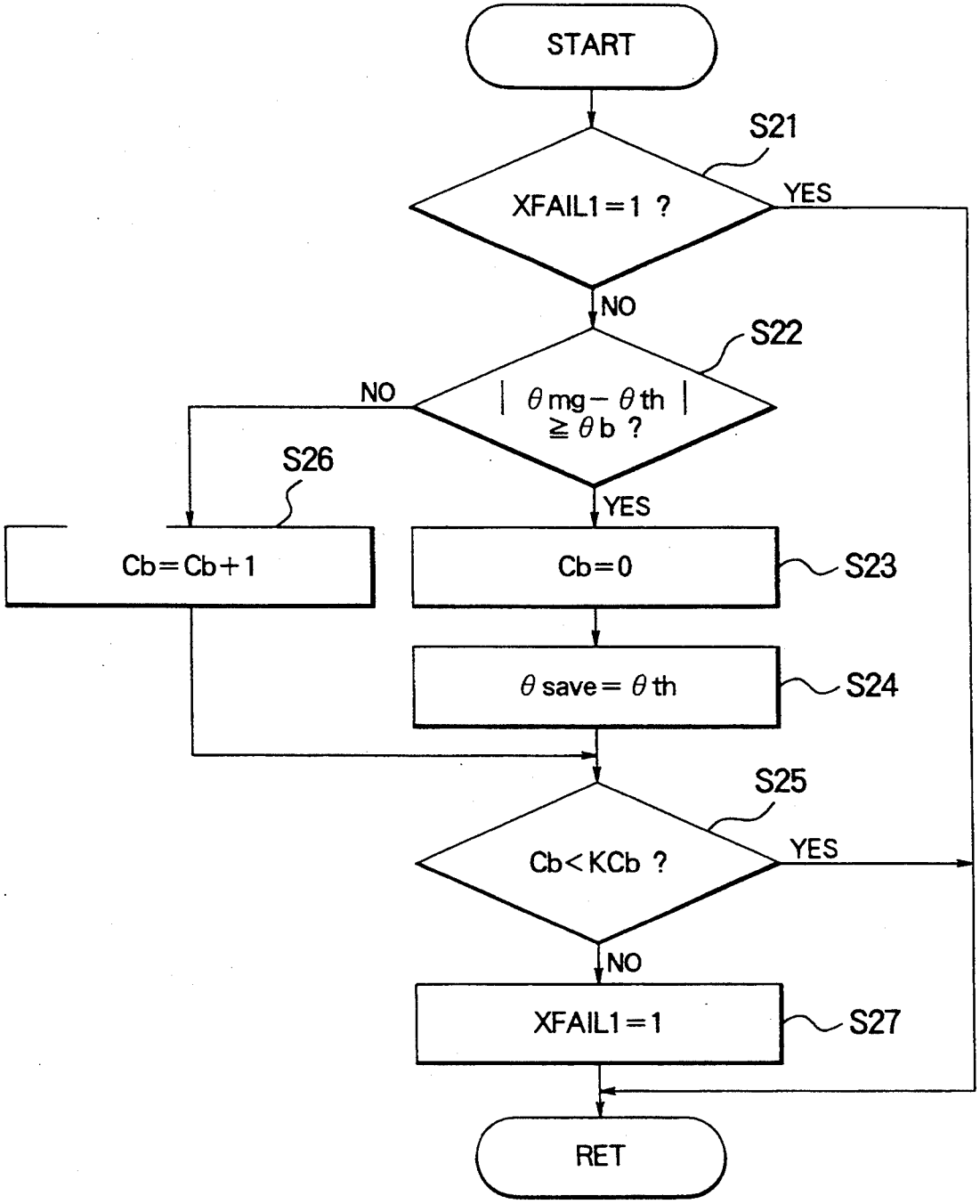
FIG. 9 is a flow chart showing a second throttle control system abnormality judgement routine performed by the CPU of the throttle control apparatus for an internal combustion engine according to an embodiment of the present invention.
Figure 10:
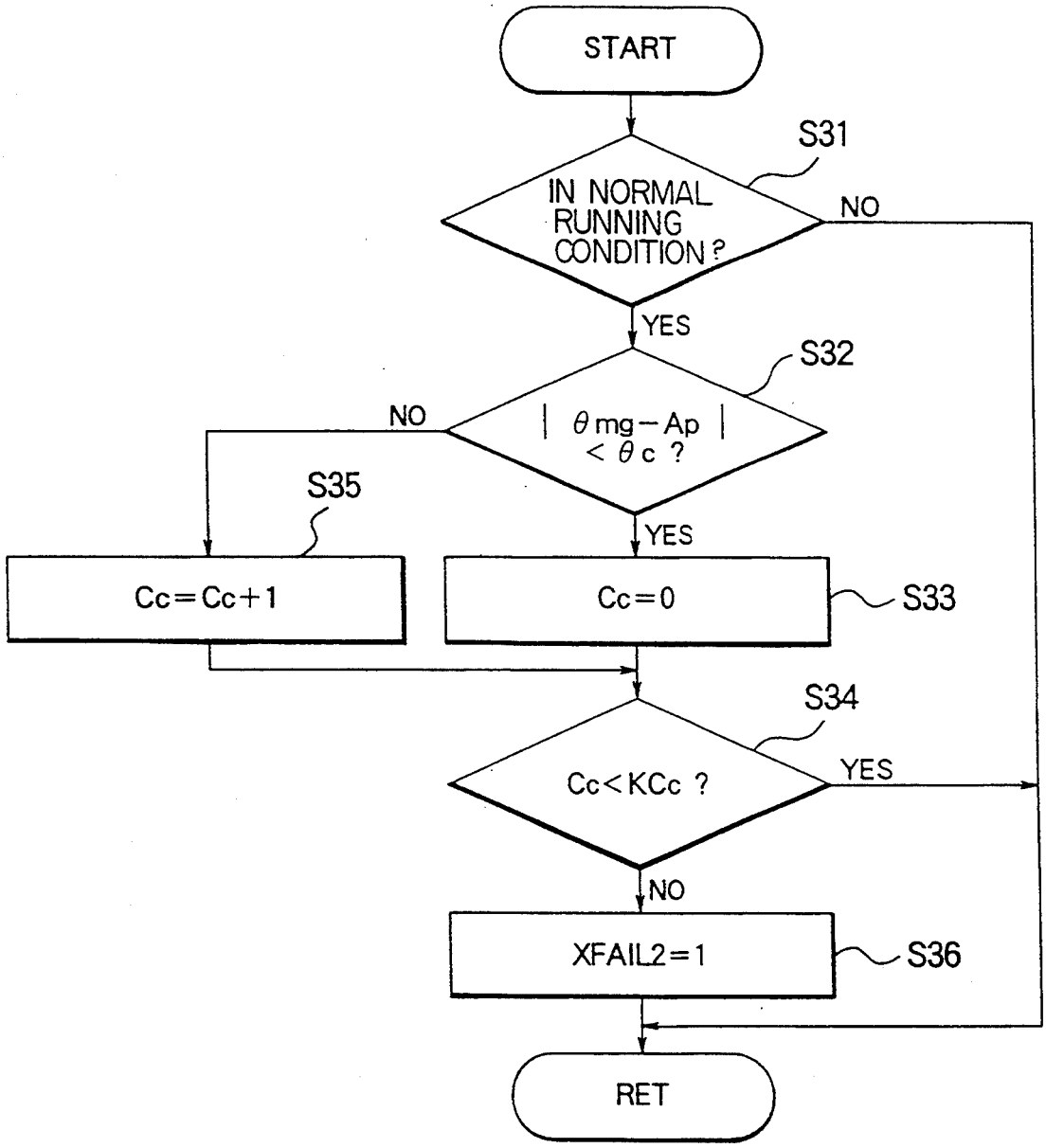
FIG. 10 is a flow chart showing an accelerator interlocking mechanism abnormality judgement routine performed by the CPU of the throttle control apparatus for an internal combustion engine according to an embodiment of the present invention.
Figure 11:
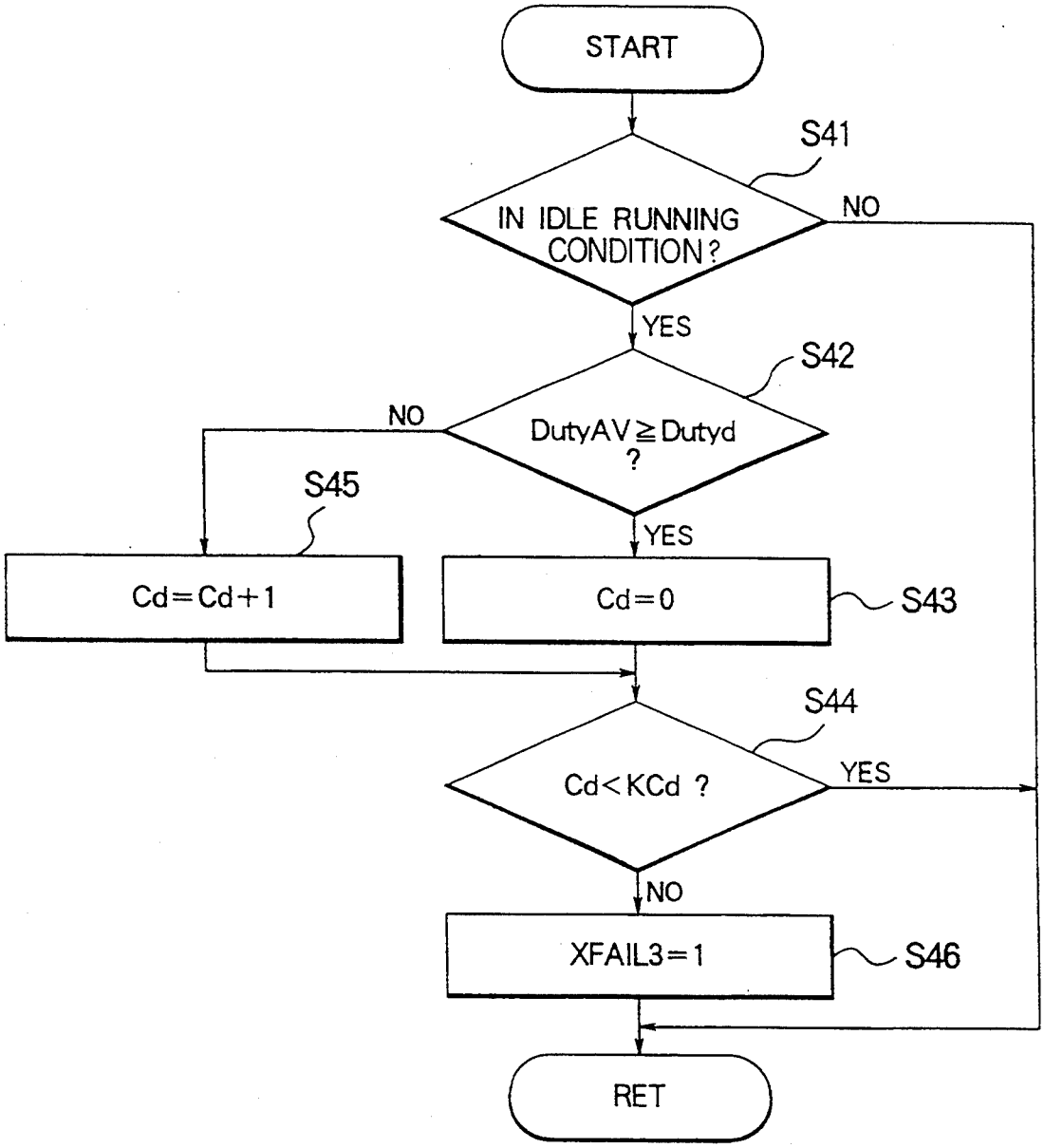
FIG. 11 is a flow chart showing a spring breakage judgement routine performed by the CPU of the throttle control apparatus for an internal combustion engine according to an embodiment of the present invention.
Figure 12:
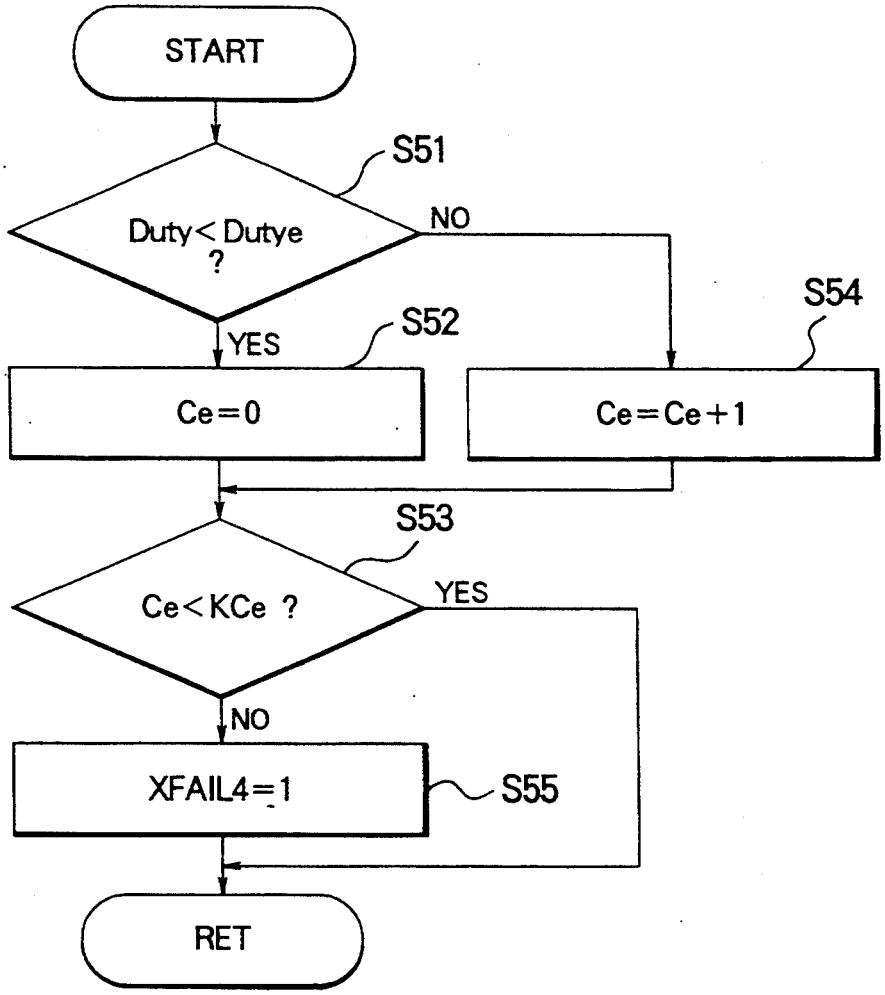
FIG. 12 is a flow chart showing a valve lock judgement routine performed by the CPU of the throttle control apparatus for an internal combustion engine according to an embodiment of the present invention.

Also, FIG. 9 is a flow chart showing a second throttle control system abnormality judgement routine performed by the CPU of the throttle control apparatus for an internal combustion engine according to the first embodiment of the present invention. FIG. 10 is a flow chart showing an accelerator interlocking mechanism abnormality judgement routine performed by the CPU of the throttle control apparatus for an internal combustion engine according to the first embodiment of the present invention. FIG. 11 is a flow chart showing a spring breakage judgement routine performed by the CPU of the throttle control apparatus for internal combustion engine according to the embodiment of the present invention. FIG. 12 is a flow chart showing a valve lock judgement routine performed by the CPU of the throttle control apparatus for an internal combustion engine according to the first embodiment of the present invention.

The throttle control routine shown in FIG. 5 is performed every 8 msec. First, the CPU 62 performs a failure judgement process as in step S1.

<Failure Judgement Routine>

When a failure judgement routine is called, the CPU 62 turns to step S10 shown in FIG. 6, The CPU 62 performs a first throttle control abnormality judgement process as in step S10, a second throttle control abnormality judgement process as in step S20, an accelerator interlocking mechanism abnormality judgement process as in step S30, a spring breakage judgement process as in step S40 and a valve lock judgement process as in step S50.

<First Throttle Control System Abnormality Judgement Routine>

In the following, the details of each abnormality judgement process will be explained. When a first throttle control system abnormality judgement routine is called in step S10, the CPU 62 turns to step S11 shown in FIG. 7. In step S11, the judgement is made as to whether or not a failure flag XFAIL1 indicative of the generation of an abnormality of the throttle control system has already been set by the first throttle control system abnormality judgement routine and a second throttle control system abnormality judgement routine which will be mentioned later on. When the failure flag XFAIL1 has not been set, the present throttle opening angle ΘcmdO under control (hereinafter referred to simply as "control estimated opening angle") is determined in accordance with the following equation on the basis of a throttle opening angle command value Θcmd as a target value for throttle opening angle control (step S12):

$$\Theta 12cmdO = K1 \cdot \Theta cmdi + K2d\Theta cmd(i-1) + K2 - \Theta cmdO(i-1) + K3 \cdot \Theta cmdO(i-2)$$

where K1 to K3 are predetermined constants, Θcmdi is the present throttle opening angle command value, Θcmd(i−1) is the last throttle opening angle command value, ΘcmdO(i−1) is the last control estimated throttle opening angle and cmdO(i−2) is the last control estimated throttle opening angle.

As shown in FIG. 8, when the throttle opening angle command value Θcmd (shown by solid line) changes, it is followed by the actual control estimated throttle opening angle command value ΘcmdO (shown by broken line) with a predetermined delay. This control delay is determined by the characteristics of the DC motor 31 and the drive circuit 71. The above equation is established by approximating the DC motor 31 and the drive circuit 71 by a second-order lag filter. The control estimated throttle opening angle ΘcmdO determined from the throttle opening angle command value Θcmd in accordance with this equation includes an error which is being included by the throttle control system.

Next, the CPU 62 judges whether or not the absolute value of a difference between the control estimated throttle opening angle ΘcmdO and the actual throttle opening angle 0th converted from the output voltage Vth of the throttle opening angle sensor 34 is smaller than a predetermined value ia as set beforehand (step S13). In the case where the judgement in step S13 is affirmative (|ΘcmdO−Θth|≧Θa), a counter Ca for counting an abnormality condition continuation time is reset in step S14. Further, the throttle angle Θth at this time is stored as an upon-failure throttle angle Θsave in the RAM 64 in step S15 and thereafter the flow goes to step S16.

On the other hand, in the case where the judgement in step S13 is negative (|ΘcmdO−Θth|≧Oa), the counter Ca is incremented by +1 in step S17 and thereafter the flow goes to step S16. In step S16, the judgement is made as to whether or not the counter Ca is smaller than a predetermined value KCa as set beforehand. When the judgement in step S16 is affirmative (Ca<KCa), this first throttle control system abnormality judgement routine is completed. When the judgement in step S16 is negative (Ca>KCa), the failure flag XFAIL1 is set in step S18, thereby completing the first throttle control system abnormality judgement routine.

Fundamentally, the control estimated throttle opening angle ΘcmdO as a throttle opening angle under control is to coincide with the actual throttle opening angle Θth. Accordingly, in the case where a certain degree of difference is continuously generated between the control estimated throttle opening angle ΘcmdO and the actual throttle opening angle Θth, as mentioned above, it can be assumed that an abnormality is generated in the throttle control system from any cause so that a throttle opening angle control by the DC motor 31 is not performed normally. Therefore, in this case, the judgement of the throttle control system as having failed is made by the CPU 62 so that the having failed flag XFAIL1 is set. When the first throttle control system abnormality judgement routine is performed again after the setting of the failure flag XFAIL1, the affirmative judgement in step S11 is made, thereby completing this routine immediately. Accordingly, the process in step S15 is not performed and the throttle opening angle Θth at the point of time in the judgement as having failed is continued to be stored as the upon-failure throttle opening angle Θsave in the RAM 64.

<Second Throttle Control System Abnormality Judgement Routine>

When the second throttle control system abnormality judgement routine is called in step 20 of the failure judgement routine, the CPU 62 turns to step S21 shown in FIG. 9. Similarly to step S11 of the first throttle control system abnormality judgement routine, the judgement is made as to whether or not the failure flag XFAIL1 has already been set (step S21). When the failure flag XFAIL1 has not been set, the flow goes to step 22. In step S22, the judgement is made as to whether or not a difference between a guard position Θmg detected by the guard position sensor 48 and a throttle opening angle Θth detected by the throttle opening angle sensor 34 is not smaller than a predetermined value Θb as set beforehand. In the case where the judgement in step S22 is affirmative (|8 mg−Θth|≧Θb), a counter Cb for counting an abnormality condition continuation time is reset in step S23. The throttle angle Θth at this time is stored as an upon-failure throttle angle Θsave into the RAM 64 in step S24 and thereafter the flow goes to step S25.

On the other hand, in the case where the judgement in step S22 is negative (|Θmg−Θth|≧∝Θb), the counter Cb is incremented by+1 in step S26 and thereafter the flow goes to step S25. In step S25, the judgement is made as to whether or not the counter Cb is smaller than a predetermined value KCb as set beforehand. When the judgement in step S25 is affirmative (Cb≧KCb), this second throttle control system abnormality judgement routine is completed. When the judgement in step S25 is negative (Cb 2 KCb), the failure flag XFAIL1 is set in step S27, thereby completing the second throttle control system abnormality judgement routine.

The actual throttle opening angle Θth is to be positioned at a closed side with a predetermined difference or a difference larger than that relative to the guard position Θmg. Accordingly, in the case where a state with the difference between the guard position Θmg and the throttle angle Θth being decreased is continuously generated, as mentioned above, a process similar to that in the first throttle control system abnormality judgement routine is performed or the failure flag XFAIL1 is set on the assumption that a throttle opening angle control by the DC motor 31 is not normally performed. After the failure flag XFAIL1 is set, since the affirmative judgement in step S21 is made and hence the process in step 24 is not performed, the throttle opening angle Θth at the point of time of the judgement as having failed is continued to be stored as the upon-failure throttle opening angle Θsave in the RAM 64.

<Accelerator Interlocking Mechanism Abnormality Judgement Routine>

On the other hand, when an accelerator interlocking mechanism abnormality judgement routine is called in step S30 of the failure judgement routine, the CPU 62 turns to step S31 shown in FIG. 10. First, the judgement is made as to whether or not the internal combustion engine 1 is in a normal running (step S31). If a cruise control or cold start is not made, the CPU 62 turns to step S32 on the assumption that the engine 1 is in a normal running condition. Next, the judgement is made as to whether or not the absolute value of a difference between a guard position Θmg detected by the guard position sensor 48 and the amount of accelerator operation Ap detected by the accelerator position sensor 47 is smaller than a predetermined value Θc as set beforehand (step S32). In the case where the judgement in step S32 is affirmative (|Θmg−Ap|<Θc), a counter Cc for counting an abnormality condition continuation time is reset in step S33 and thereafter the flow goes to step 34.

In the case where the judgement in step S32 is negative (|Θmg−Ap|2Θc), the counter Cc is incremented by +1 in step 35 and thereafter the flow goes to step S34. In step S34, the judgement is made as to whether or not the counter Cc is smaller than a predetermined value KCc as set beforehand. When the judgement in step S34 is affirmative (Cc<Kcc), this accelerator interlocking mechanism abnormality judgement routine is completed. When the judgement in step S34 is negative (Cc<Kcc), a failure flag XFAIL2 indicative of the generation of an abnormality of the accelerator interlocking mechanism 22 is set in step S36, thereby completing the accelerator interlocking mechanism abnormality judgement routine.

A guard position Θmg, when a cruise control or cold start is not made, is to always correspond to the amount Ap of accelerator operation since a change to the opening direction by the diaphragm actuator 49 or the thermowax 50 is not made. Accordingly, in the case where a certain degree of difference is continuously generated between the guard position Θmg and the amount of accelerator operation Ap, as mentioned above, it can be assumed that excess play exists in the accelerator interlocking mechanism 22 from any cause. In this case, an accurate throttle opening/closing operation corresponding to the amount of accelerator operation Ap cannot be expected even when the throttle valve 5 is opened/closed by the accelerator interlocking mechanism 22. Accordingly, in such a case, the judgement of the accelerator interlocking mechanism 22 as having failed is made by the CPU 62 so that the failure flag XFAIL2 is set.

If it is determined in step S31 that the internal combustion engine 1 is not in a normal running condition, the accelerator interlocking mechanism abnormality judgement routine is immediately completed on the assumption that it is impossible to judge the presence/absence of an abnormality since the guard position Θmg has already been changed to the opening direction or opened side by the diaphragm actuator 49 or the thermowax 50.

<Spring Breakage Judgement Routine>

When a spring breakage judgement routine is called in step S41 of the failure judgement routine, the CPU 62 turns to step S41 shown in FIG. 11. First, the judgement as to whether or not the internal combustion engine 1 is in an idle running condition, is made on the basis of the amount of accelerator operation Ap (step S41). When the engine 1 is in idle running, a duty ratio signal is input from the PWM circuit 73 to the CPU 62 to make the judgement as to whether or not an average value DutyAV of duty ratios Duty per a predetermined time is not smaller than a predetermined value Dutyd as set beforehand (step S42). In the case where the judgement in step S42 is affirmative (DutyAV≧Dutyd), a counter Cd for counting an abnormality condition continuation time is reset in step S43 and thereafter the flow goes to step 44.

In the case where the judgement in step S42 is negative (DutyAV<Dutyd), the counter Cd is incremented by+1 in step 45 and thereafter the flow goes to step S44. In step S44, the judgement is made as to whether or not the counter Cd is smaller than a predetermined value KCd as set beforehand. When the judgement in step S44 is affirmative (Cd<KCd), this spring breakage judgement routine is completed. When the judgement in step S44 is negative (Cd≧Kcd), a failure flag XFAIL3 indicative of the generation of spring breakage is set in step S46, thereby completing the spring breakage judgement routine.

When the internal combustion engine 1 is in an idle running condition, the throttle valve 5 is held substantially at a fixed opening angle in the vicinity of a fully closed condition through an ISC control and hence the sum of the energizing forces of the valve springs 25 and the return spring 32 assumes substantially a fixed value. Accordingly, if normal, the average value DutyAV of duty ratios Duty given to the DC motor 31 against those energizing forces is to be converged substantially to a fixed value. In the case where a state in which the average value DutyAV is continuously smaller that a usual value, it can be assumed that either the spring 25 or 32 is broken and hence there is a possibility that a smooth throttle opening angle control cannot be made. Therefore, in such a case, the spring breakage judgement as having failed is made by the CPU 62 so that the failure flag XFAIL3 is set.

The reason why the breakage of the springs 25 and 32 is judged on the basis of the average value DutyAV, is that accurate judgement cannot be expected from the duty ratio Duty itself since the duty ratio in this case includes variations in order to maintain the idle rotation speed.

Also, in the case where it is determined in step S41 that the internal combustion engine 1 is not in an idle running condition, the opening angle of the throttle valve 5 is on an opened side as compared with that at the time of an idle running condition and hence the energizing forces of the valve springs 25 and the return spring 32 are below expected values. In such a case, therefore, this spring breakage judgement routine is completed immediately on the assumption that it is impossible to judge the presence/absence of spring breakage.

<Valve Lock Judgement Routine>

When a valve lock judgement routine is called in step S50 of the failure judgement routine, the CPU 62 turns to step S51 shown in FIG. 12. First, a duty ratio signal is input from the PWM circuit 73 to the CPU 62 to make the judgement as to whether or not the duty ratio Duty is smaller than a predetermined value Dutye as set beforehand (step S51). In the case where the judgement in step S51 is affirmative (Duty<Dutye), a counter Ce, for counting an abnormality condition continuation time is reset in step S52 and thereafter the flow goes to step 53.

In the case where the judgement in step S51 is negative (Duty≧Dutye), the counter Ce is incremented by +1 in step 54 and thereafter the flow goes to step S53.

In step S53, the judgement is made as to whether or not the counter Ce is smaller than a predetermined value KCe as set beforehand. When the judgement in step S53 is affirmative (Ce<KCe), this valve lock judgement routine is completed. When the judgement in step S53 is negative (Ce≧Kce), a failure flag XFAIL4 indicative of the generation of a valve lock is set in step S55, thereby completing the valve lock judgement routine.

When a valve lock (or the sticking of the throttle valve 5) is generated due to foreign materials or the like in the intake path 2, the actual throttle opening angle 0th does not reach a throttle opening angle command value Θcmd even if the throttle valve 5 is driven for opening/closing by the DC motor 31. Accordingly, a duty ratio Duty at this time is suddenly increased by the control of the PID control circuit 72. If this situation is continued for a time longer than that which may be considered normal in a normal control condition, it can be assumed that the opening/closing of the throttle valve 5 has become impossible. Accordingly, in such a case, the valve lock judgement as having failed is made by the CPU 62 so that the failure flag XFAIL4 is set.

Figure 13:
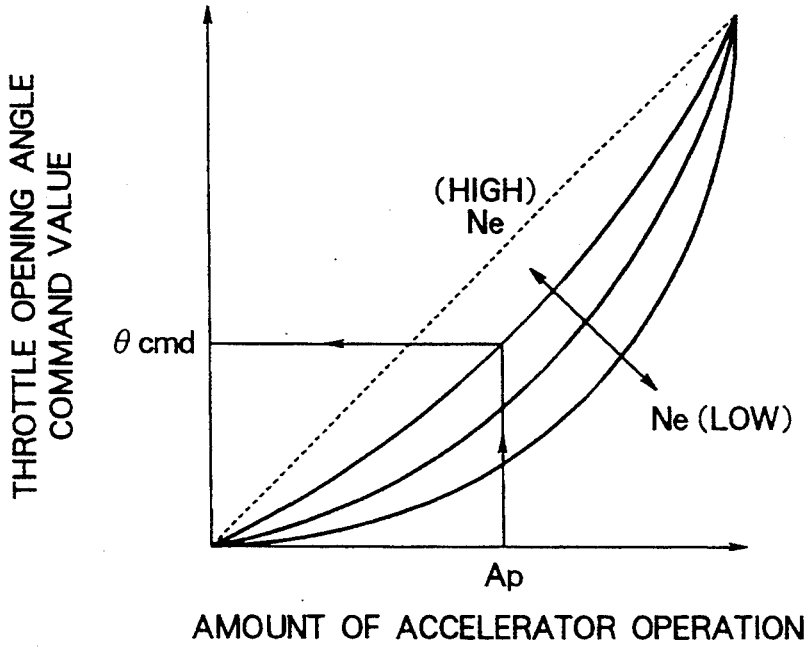
FIG. 13 is an explanatory diagram showing a map for determining a throttle opening angle command value at the time of a normal control in the throttle control apparatus for an internal combustion engine according to an embodiment of the present invention.
Figure 14:
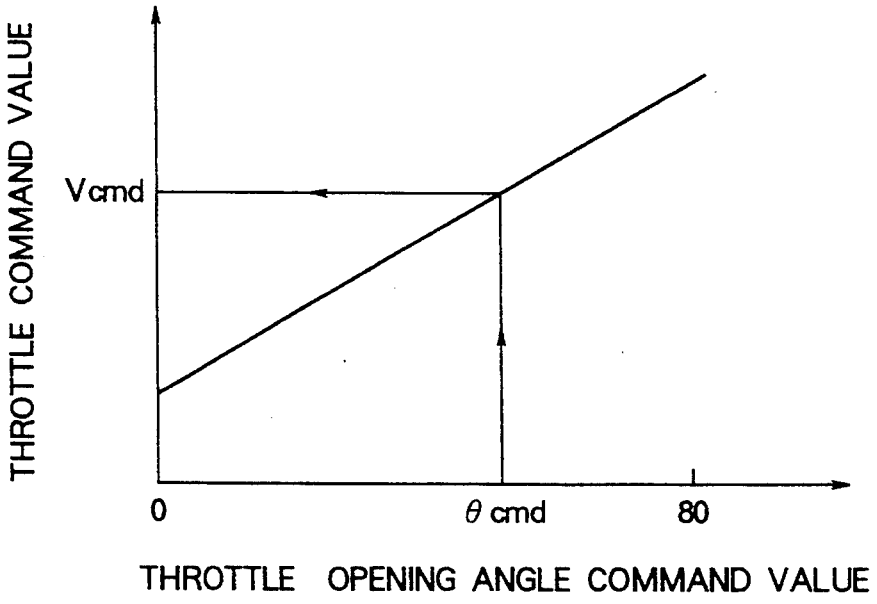
FIG. 14 is an explanatory diagram showing a map for determining a throttle command voltage in the throttle control apparatus for an internal combustion engine according to an embodiment of the present invention.
Figure 15:
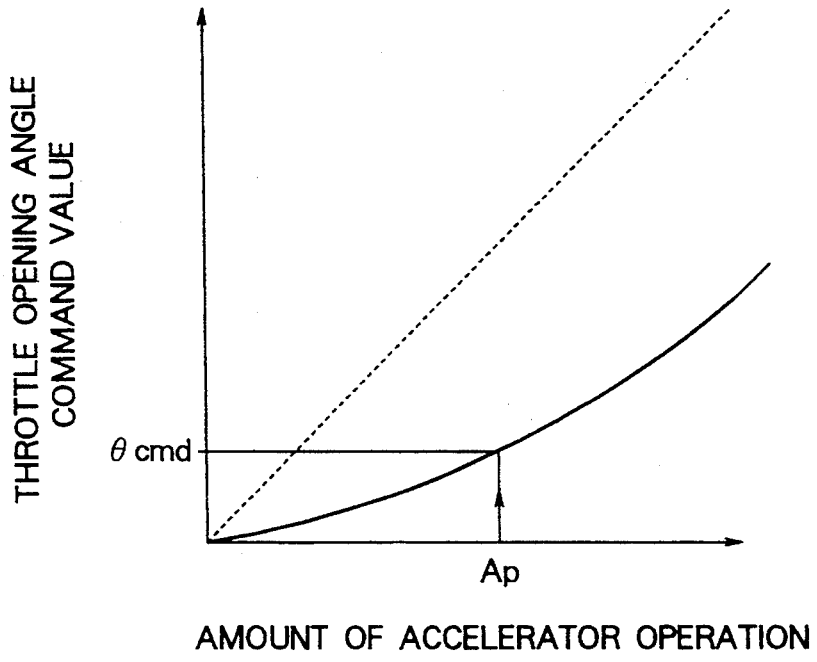
FIG. 15 is an explanatory diagram showing a map for determining a throttle opening angle command value at the time of a limp home control in the throttle control apparatus for an internal combustion engine according to an embodiment of the present invention.
Figure 16:
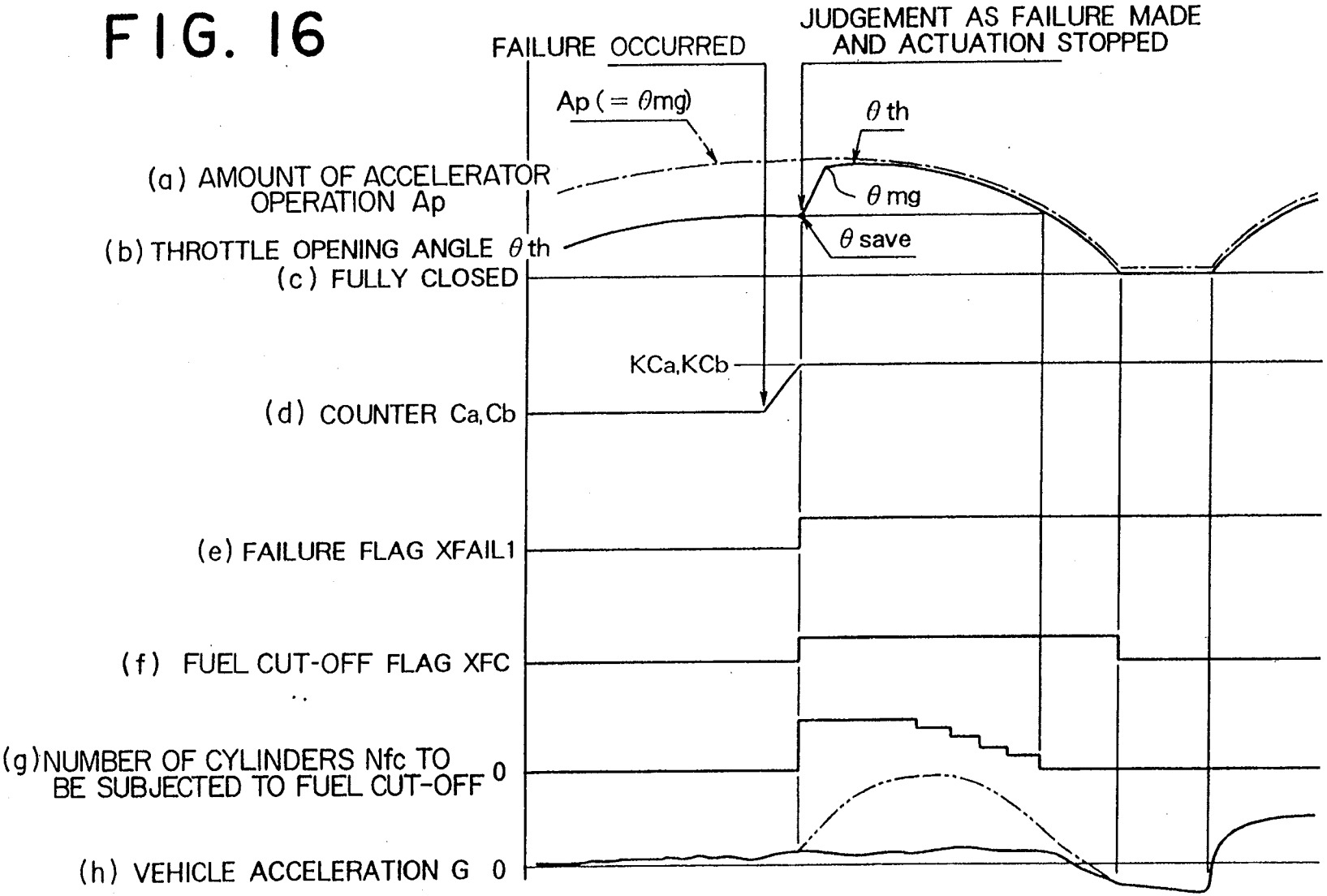
FIG. 16 is a time chart of a throttle control system at the time of generation of an abnormality in the throttle control apparatus for an internal combustion engine according to an embodiment of the present invention.

FIG. 13 is an explanatory diagram showing a map for determining a throttle opening angle command value at the time of normal control in the throttle control apparatus for an internal combustion engine according to the first embodiment of the present invention. FIG. 14 is an explanatory diagram showing a map for determining a throttle command voltage in the throttle control apparatus for an internal combustion engine according to the first embodiment of the present invention. FIG. 15 is an explanatory diagram showing a map for determining a throttle opening angle command value at the time of a limp home control in the throttle control apparatus for an internal combustion engine according to the first embodiment of the present invention. FIG. 16 is a time chart of a throttle control system at the time of generation of an abnormality in the throttle control apparatus for an internal combustion engine according to the first embodiment of the present invention.

When the failure judgement process is completed in the above-mentioned manner, the CPU 62 returns to the throttle control routine shown in FIG. 5 and then judges whether or not all the failure flags XFAIL1 to XFAIL4 are cleared (step S2). In the case where it is determined in step S2 that all the failure flags XFAIL1 to XFAIL4 are cleared (XFAIL1~4=0), a normal throttle control is performed by processes in and after step S3 on the assumption that all throttle functions of the internal combustion engine 1, for example, the throttle control system, the accelerator interlocking mechanism 22 and so on are normal.

Namely, in accordance with a map shown in FIG. 13 and stored beforehand in the ROM 63, the CPU 62 determines a throttle opening angle command value Θcmd at the time of normal throttle control from the amount of accelerator operation Ap detected by the accelerator position sensor 47 and an engine rotation speed Ne determined on the basis of a pulse signal from the crank angle sensor 15 (step S3).

Next, the CPU 62 determines a throttle command voltage Vcmd from the throttle opening angle command value Θcmd in accordance with a map shown in FIG. 14 and stored beforehand in the ROM 63 (step S4). Further, the CPU 62 outputs the throttle command value Vcmd to the PID control circuit 72 of the DC motor driving circuit 71 through the D/A converter circuit 67 (step S5), thereby completing the throttle control routine.

The throttle command voltage Vcmd output from the CPU 62 is compared with an output voltage Vth of the throttle angle sensor 34 by the PID control circuit 72. A proportional, integrating and differentiating operation for reducing a deviation between both the values of voltages is performed to determine the amount of control of the throttle valve 5. Further, the amount of control is converted into a duty ratio signal by the PWM circuit 73. The DC motor 31 is driven by the driver 74 in accordance with the duty ratio signal. The processes of steps S1 to S5 by the CPU 62 and the drive control of the DC motor 31 by the DC motor drive circuit 71 as mentioned above are repeatedly performed so that the actual throttle opening angle Θth is adjusted into the throttle opening angle command value Θcmd.

On the other hand, in the case where it is determined in step S2 that any one of the failure flags XFAIL1 to XFAIL4 is set (XFAIL1~4≠0), a control signal is output to the lamp drive circuit 68 to light the warning lamp 69 (step S6). Next, the kind of the set one of the failure flags XFAIL1 to XFAIL4 is judged in step S7. When the failure flag XFAIL3 is set, it is assumed that the valve springs 25 or the return spring 32 are broken. Then, the flow goes to step S3, thereby performing the normal throttle control in a manner similar to that in the above-mentioned case where all the throttle functions are normal.

Namely, since the breakage of either the valve springs 25 or the return spring 32 does not prove an immediate hindrance to the travel of a vehicle, the attraction of a driver's attention to the lighting of the warning lamp 69 suffices to inform the driver to check or repair same.

When it is determined in step S7 that the failure flag XFAIL2 is set, it is assumed that excess play exists in the accelerator interlocking mechanism 22. Then, the flow goes to step S8, thereby performing a so-called limp home control. Namely, in accordance with a map shown in FIG. 15 and stored beforehand in the ROM 63, the CPU 62 determines a throttle opening angle command value Θcmd at the time of a limp home control from the amount of accelerator operation Ap detected by the accelerator position sensor 47 (step S8). It is apparent from comparison with FIG. 13 that a smaller throttle opening angle command value Θcmd is set in the limp home control. In step S4, a throttle command voltage Vcmd is determined from the throttle opening angle command value Θcmd. In step S5, the throttle command value Vcmd is output to the PID control circuit 72.

Namely, at the point of time when a change-over is made from the normal throttle control to the limp home control, the throttle opening angle command value Θcmd is greatly decreased so that the throttle valve 5 is controlled in the closing direction. Accordingly, an engine torque is decreased irrespective of an accelerator operation. Therefore, a driver can perceive an abnormality rapidly on the basis of the decrease in torque with no need to visually confirm the warning lamp 69. Also, even after the change-over to the limp home control, the travel of the vehicle can be continued since a throttle opening angle control is performed. Since the throttle opening angle is suppressed, a careful operation by the driver is demanded.

When it is determined in step S7 that the failure flag XFAIL1 or XFAIL4 is set, the flow goes to step S9 on the assumption that an abnormality is generated in the throttle control system or a valve lock is generated. Then, the actuation of the DC motor 31 is stopped in step S9, thereby completing the throttle control routine.

When a valve lock is generated, the opening/closing of the throttle valve S is prevented. Therefore, even if the actuation of the DC motor 31 is stopped, the throttle opening angle Eth does not change. On the other hand, when an abnormality of the throttle control system is generated, the opening/closing of the throttle valve 5 is free. Therefore, the stoppage of the actuation of the DC motor 31 is followed by the rotational operation of the throttle valve 5 by the energizing forces of the valve springs 25 and the return spring 32 in the opening direction so that the throttle opening angle Θth changes to a guard position Θmg, as shown in FIG. 16. Thereafter, the throttle valve 5 is mechanically opened/closed by the accelerator interlocking mechanism 22 in accordance with an accelerator operation.

In the case where the generation of an abnormality of the throttle control system or the generation of a valve lock is present in addition with the stoppage of the actuation of the DC motor 31, a so-called fuel cut-off for ceasing the injection of fuel to a specified cylinder(s) of the internal combustion engine 1 is carried out so that the cylinder is held in a ceased condition. Explanation will now be made of a fuel injection control processing performed by the CPU 62.

[Fuel Injection Control Processing]

Figure 17:
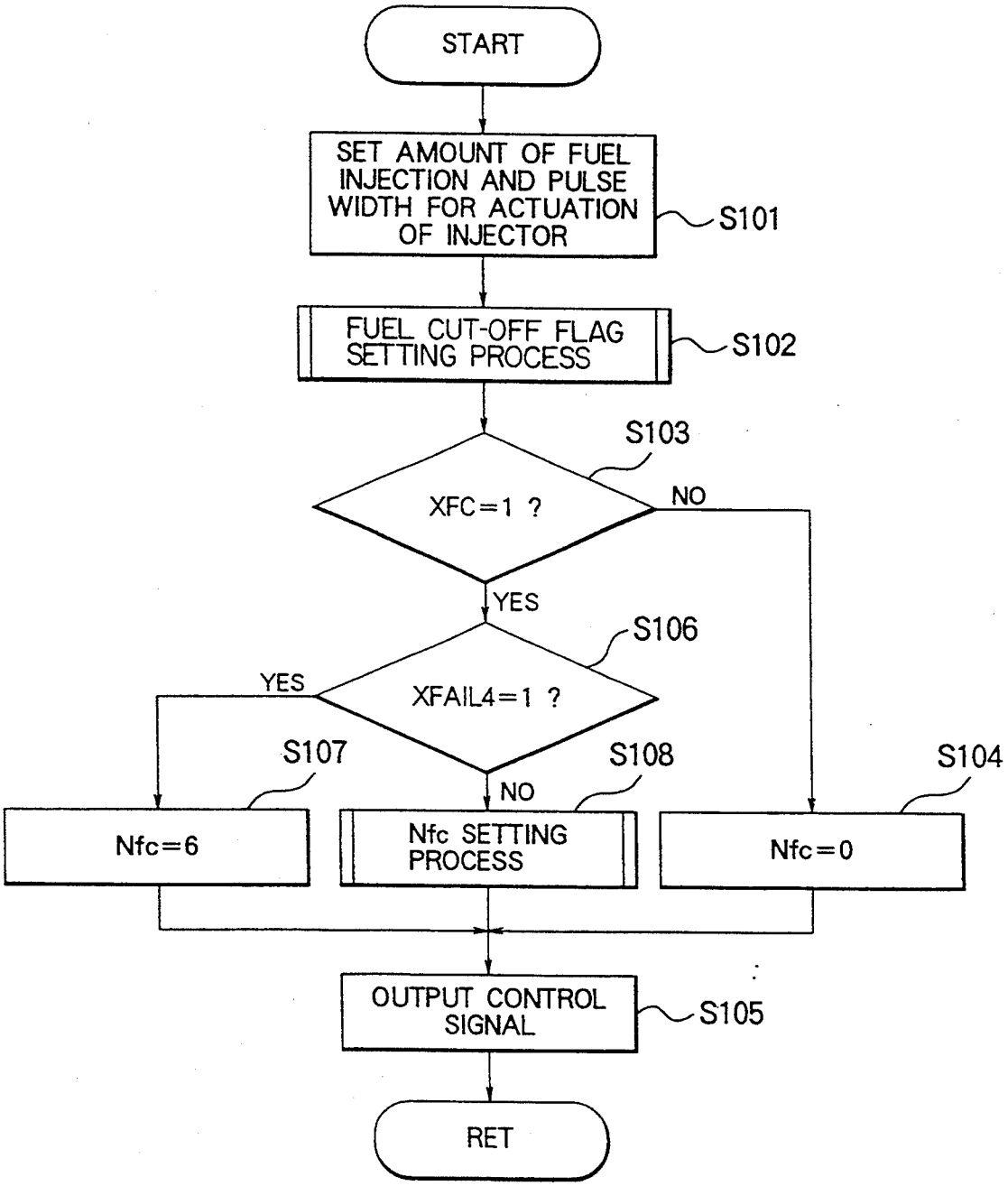
FIG. 17 is a flow chart showing a fuel injection control routine performed by the CPU of the throttle control apparatus for an internal combustion engine according to an embodiment of the present invention.
Figure 18:
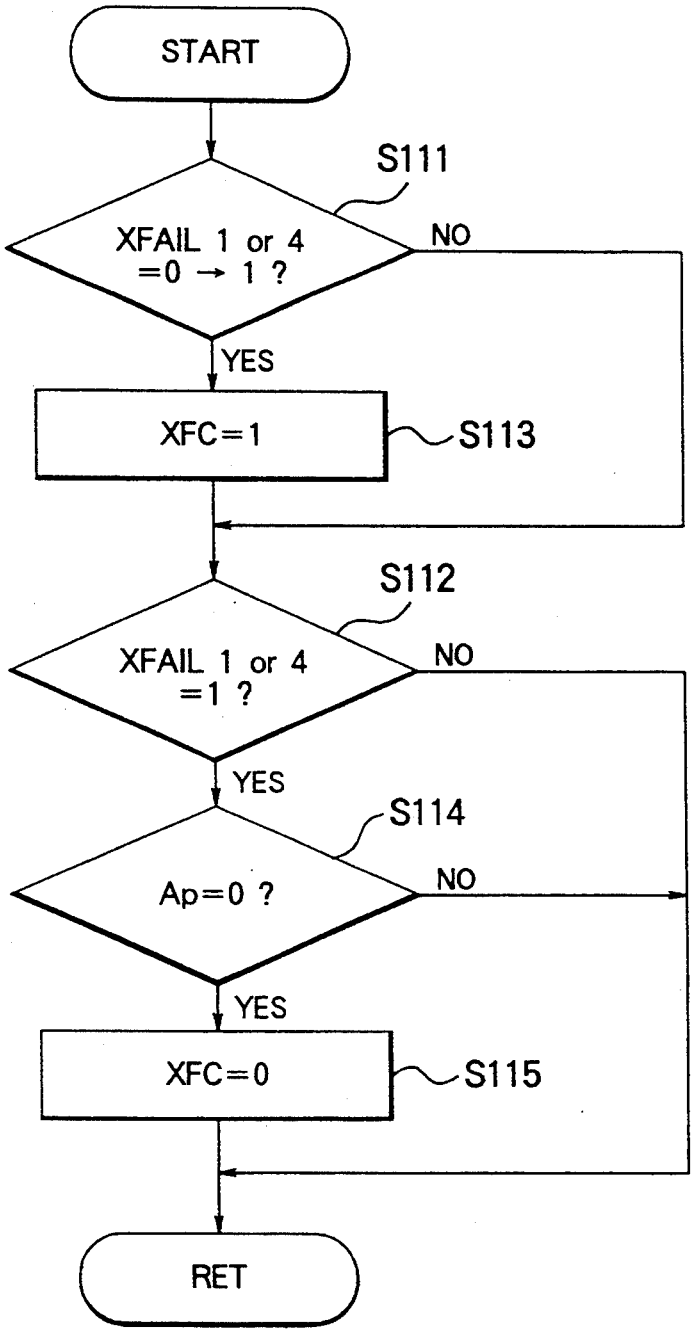
FIG. 18 is a flow chart showing a fuel cut-off flag setting routine performed by the CPU of the throttle control apparatus for an internal combustion engine according to an embodiment of the present invention.

FIG. 17 is a flow chart showing a fuel injection control routine performed by the CPU of the throttle control apparatus for an internal combustion engine according to the first embodiment of the present invention. FIG. 18 is a flow chart showing a fuel cut-off flag setting routine performed by the CPU of the throttle control apparatus for an internal combustion engine according to the embodiment of the present invention.

A fuel injection control routine shown in FIG. 17 is performed at each 720° in terms of the crank angle of the internal combustion engine 1. First, the CPU 62 determines the amount of fuel injection presently requested by the internal combustion engine 1 from the amount of intake air Qa detected by the air flow meter 4 and the engine rotation speed Ne detected by the crank angle sensor 15 and sets a pulse width corresponding to the determined amount of fuel injection (step S101). Next, a fuel cut-off flag setting process is performed in step S102.

<Fuel Cut-off Flag Setting Processing>

When a fuel cut-off flag setting routine is called, the CPU 62 turns to step S111 shown in FIG. 18.

Explanation will now be made for the occasion when an abnormality of the throttle control system or a valve lock has not been generated and hence both the failure flags XFAIL1 and XFAIL4 have been cleared.

In step S111, the CPU 62 judges whether or not the failure flag XFAIL1 or XFAIL4 having been cleared is set. Since neither the failure flag XFAIL1 nor the failure flag XFAIL4 is set, the flow goes to step S112 in which the judgement is made as to whether or not the failure flag XFAIL1 or XFAIL4 is presently set. Since neither the failure flag XFAIL1 nor the failure flag XFAIL4 is set as in step S111, this fuel cut-off flag setting routine is completed. Namely, so long as an abnormality of the throttle control system or a valve lock is not generated, nothing is made in this routine.

When the judgement as having failed is made due to the generation of an abnormality of the throttle control system or a valve lock so that the failure flag XFAIL1 or XFAIL4 is set, the flow goes from step 111 to step S113 in which a fuel cut-off flag XFC indicative of the execution of a fuel cut-off process is set. Next, the flow goes through step 112 to step S114 in which the judgement is made as to whether or not the amount of accelerator operation Ap is 0. In the case where the amount of accelerator operation is not 0 (Ap=0) or an accelerator operation is being performed, the fuel cut-off flag setting routine is completed. Thereafter, the processes in steps S111, S112 and S114 are repeatedly performed so long as the accelerator operation is being performed. When it is determined in step S114 that the amount of accelerator operation Ap is 0 (Ap=0), the fuel cut-off flag XFC is cleared in step S115.

Accordingly, the fuel cut-off flag XFC is held at a set condition during a period of time from the judgement as having failed to the stoppage of an accelerator operation, as shown in FIG. 16.

When the fuel cut-off flag setting process is completed in the above-mentioned manner, the CPU 62 returns to the fuel injection control routine shown in FIG. 17. In step S103, the CPU 62 judges whether or not the fuel cut-off flag XFC is cleared. When the fuel cut-off flag XFC is cleared (XFC=0), that is, when an abnormality of the throttle control system or a valve lock is not generated, the flow goes to step S104 in which the number of cylinders Nfc to be subjected to fuel cut-off is set to 0 (Nfc=0). In step S105, a control signal having a pulse width set in step S101 is output from the CPU 62 to the injector drive circuit 65 for all cylinders of the internal combustion engine 1. Accordingly, all the injectors 7 are actuated by the injector drive circuit 65 into fuel injection so that all the cylinders of the internal combustion engine 1 are operated. Namely, in this case, a normal fuel injection control is performed.

When it is determined in step S103 that the fuel cut-off flag XFC is set (XFC=1), that is, when an abnormality of the throttle control system or a valve lock is generated, the flow goes to step S106 in which the judgement is made as to whether or not the failure flag XFAIL4 is set. In the case where the failure flag XFAIL4 is set, the number of cylinders Nfc to be subjected to fuel cut-off is set to 6 (Nfc=6) in step S107 on the assumption that the valve lock involves an abnormality. In step S105, the outputting of a control signal from the CPU 62 to the injector drive circuit 65 is stopped for all the cylinders.

Accordingly, the fuel injection from all the injectors 7 is ceased so that all the cylinders of the internal combustion engine 1 are operationally ceased or put out of operation. Therefore, when the valve lock is generated, an engine torque is surely suppressed to 0 by the cessation of fuel injection irrespective of the opening angle of the locked throttle valve 5 so that the travel of a vehicle is stopped.

When it is determined in step S106 that the failure flag XFAIL4 is not set, a process for setting the number of cylinders Nfc to be subjected to fuel cut-off is performed in step S108 on the assumption that the throttle control system involves an abnormality.

Figure 19:
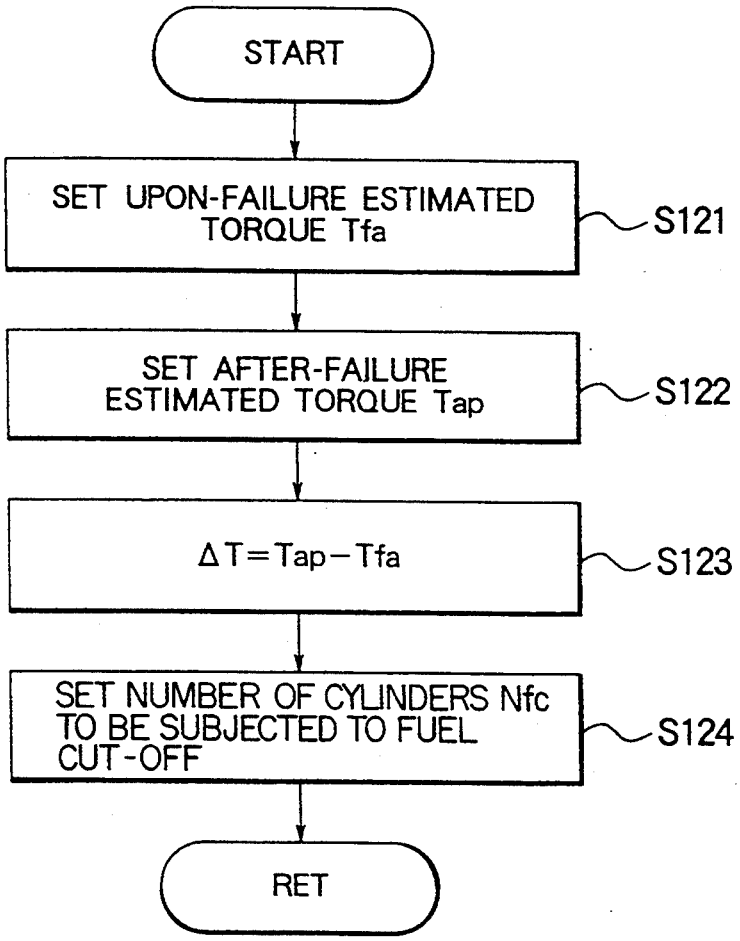
FIG. 19 is a flow chart showing a routine for setting the number of cylinders to be subjected to fuel cut-off which routine is performed by the CPU of the throttle control apparatus for internal combustion engine according to the embodiment of the present invention.
Figure 20:
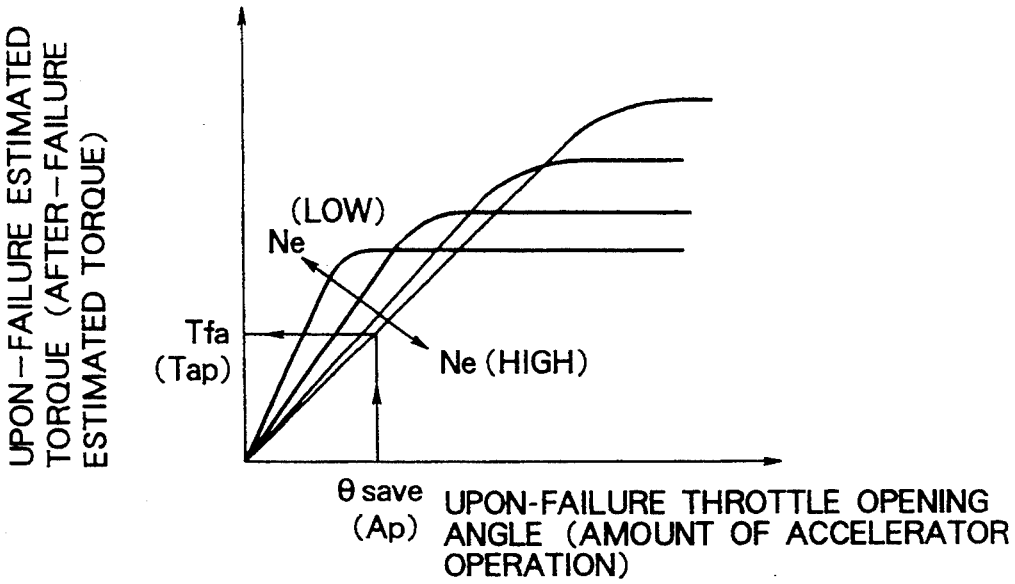
FIG. 20 is an explanatory diagram showing a map for determining an estimated torque in the throttle control apparatus for an internal combustion engine according to an embodiment of the present invention.
Figure 21:
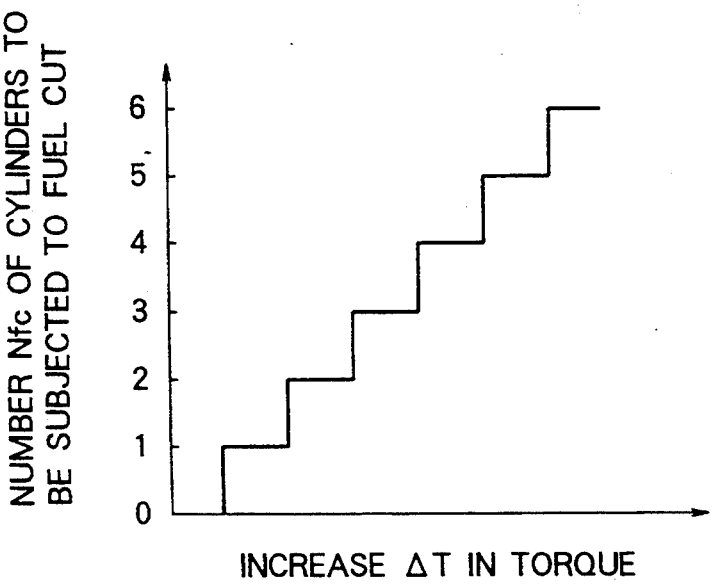
FIG. 21 is an explanatory diagram showing a map for determining the number of cylinders to be subjected to fuel cut-off in the throttle control apparatus for an internal combustion engine according to an embodiment of the present invention.

FIG. 19 is a flow chart showing a routine for setting of the number of cylinders Nfc to be subjected to fuel cut-off which routine is performed by the CPU of the throttle control apparatus for an internal combustion engine according to the first embodiment of the present invention. FIG. 20 is an explanatory diagram showing a map for determining an estimated torque in the throttle control apparatus for an internal combustion engine according to the first embodiment of the present invention. FIG. 21 is an explanatory diagram showing a map for determining the number of cylinders Nfc to be subjected to fuel cut-off in the throttle control apparatus for an internal combustion engine according to the first embodiment of the present invention.

When a routine for setting the number of cylinders Nfc to be subjected to fuel cut-off is called, the CPU 62 turns to step S121 shown in FIG. 19. First, an upon-failure estimated torque Tfa, which is an engine torque of the internal combustion engine 1 at the time of the judgement as having failed, is determined from an upon-failure throttle angle Θsave stored in the RAM 64 and an engine rotation speed Ne detected by the crank angle sensor 15 in accordance with a map which is shown in FIG. 20 and is stored beforehand in the ROM 63 (step S121). The characteristic of the map shown in FIG. 20 is determined from the actual torque characteristic of the internal combustion engine 1. For example, in the case where the engine rotation speed Ne is low, the upon-failure estimated torque Tfa is suppressed to a small value since the upper limit of the actual engine torque for the amount of accelerator operation Ap is low.

Next, an after-failure estimated torque Tap, which is the present engine torque after the judgement as having failed, is determined in accordance with the map of FIG. 20 from the amount of accelerator operation Ap detected by the accelerator position sensor 47 and the engine rotation speed Ne detected by the crank angle sensor 15 (step S122. Further in step 5123, the upon-failure estimate torque Tfa is subtracted from the after-failure estimated torque Tap to determine an increase in torque ΔT (ΔT=Tap−Tfa). The increase ΔT in torque indicates an increase in engine torque when the throttle opening angle Θth is changed to a guard position Θmg in the opening direction due to the stoppage of actuation of the DC motor 31.

As shown by the map of FIG. 13, the throttle opening angle command value Θcmd is determined such that the command value in a region in the vicinity of a fully-closed position and a fully-opened position is approximated to the amount of accelerator operation Ap, the command value in an intermediate region is set to a small value as compared with the amount of accelerator operation Ap and the command value in the intermediate region is set to a smaller value as the engine rotation speed Ne is lower. Accordingly, the amount of change in throttle opening angle Θth, when it is changed to the guard position Θmg at the time of the judgement as failure, differs in accordance with the amount of accelerator operation Ap and the engine rotation speed Ne at that point of time and hence the increase ΔT in torque is also changed correspondingly. Therefore, the processes from step S121 to step S123 are performed for estimating engine torques before and after the judgement as having failed (the upon-failure estimated torque Tfa and the after failure estimated torque Tap) to determine an increase ΔT in torque.

In step S124, the CPU 62 determines the number of cylinders Nfc to be subjected to fuel cut-off from the increase ΔT in torque in accordance with a map shown in FIG. 21 and stored beforehand in the ROM 63, thereby completing this routine for setting the number of cylinders to be subjected to fuel cut-off. As apparent from FIG. 21, the number of cylinders Nfc to be subjected to fuel cut-off is set to a larger value with the increase of the increase ΔT in torque.

Thereafter, the CPU 62 returns to the fuel injection control routine of FIG. 17. Namely, in step S105, the CPU 62 outputs a control signal to the injector drive circuit 65 for cylinders corresponding to the number of cylinders Nfc to be subjected to fuel cut-off. As a result, injectors corresponding in number to the number of cylinders Nfc to be subjected to fuel cut-off are actuated by the injector drive circuit 65 to inject fuel so that those cylinders are operated.

Accordingly, when the judgement as having failed is made due to an abnormality of the throttle control system so that the throttle opening angle Θth is changed to the guard position Θmg in the opening direction, as shown in FIG. 16, the number of cylinders Nfc to be subjected to fuel cut-off is set on the basis of an increase ΔT in torque. Then, specified cylinders corresponding to the set number of cylinders Nfc to be subjected to fuel cut-off are operationally ceased or subjected to fuel cut-off so that an engine torque is decreased by an amount which is substantially equal to the increase ΔT in torque. Namely, a variation in engine torque before and after the judgement as having failed is prevented so that a vehicle acceleration G after the judgement as having failed is maintained at a very small value which is similar to that before the judgement as having failed. Therefore, an increase in engine torque against a driver's intention is surely suppressed, thereby making it possible to continue the running operation without adjusting the amount of accelerator operation Ap again.

If the operation of all the cylinders is continued with no fuel cut-off, an engine torque increases with the increase in throttle opening angle Θth so that the vehicle acceleration G is increased against the driver's intention, as shown by two-dotted chain line. In this case, therefore, the driver has a need to suppress the pushing of the accelerator pedal 44.

After the throttle opening angle Θth has been changed to the guard position Θmg in the above-mentioned manner, the throttle valve S is driven for opening/closing through the accelerator interlocking mechanism 22 and in a mechanically interlocking manner with an accelerator operation. Accordingly, a sure throttle operation can be performed continuously without being affected by an abnormality of the throttle control system at all.

When the amount of accelerator operation Ap by the driver is gradually decreased to stop the vehicle after the judgement as having failed, the after-failure estimated torque Tap determined in step S122 of FIG. 19 is decreased and hence the number of cylinders Nfc to be subjected to fuel cut-off in step 5124 is gradually decreased together with an increase ΔT in torque in step 5123. As shown in FIG. 16, at the point of time when the amount of accelerator operation Ap is decreased due to the upon-failure throttle opening angle save, the number of cylinders Nfc to be subjected to fuel cut-off returns to 0. When the amount of accelerator operation Ap is further decreased to 0, the fuel cut flag XFC is cleared in step S115 of FIG. 18. Accordingly, when the travel of the vehicle is resumed by an accelerator operation, the number of cylinders Ap to be subjected to fuel cut-off is held at 0 in step S104 of FIG. 17 so that a normal fuel injection control is performed in which fuel injection is made for all the cylinders.

Namely, the throttle control apparatus of the present embodiment is aimed at the suppression of an increase in engine torque when the throttle opening angle Vth is opened to the guard position Θmg by the judgement as having failed. Though the throttle valve during travel after the judgement as having failed is opened somewhat for the amount of accelerator operation Ap, this does not prove to be a hindrance to travel. Namely, it is not necessary to prevent the throttle opening angle Θth from being opened to the guard position Θmg. Also, though cylinders to be subjected to fuel cut-off in accordance with the number of cylinders Nfc to be subjected to fuel cut is determined taking the balance of the internal combustion engine 1 into consideration, as will be mentioned later on, an increase of the oscillation of the internal combustion engine 1 is inevitable as compared with the oscillation thereof at the time of normal fuel injection control in which fuel injection is made for all the cylinders.

Accordingly, an increase in oscillation resulting from the cylinder operation cessation after the judgement as having failed is prevented in such a manner that the number of cylinders Nfc to be subjected to fuel cut-off is held at 0 at the point of time when the amount of accelerator operation Nfc becomes 0, as mentioned above.

For reference, explanation will be made of an example of the selection of cylinders to be subjected to fuel cut-off in accordance with the number of cylinders Nfc to be subjected to fuel cut-off which is set in step S124.

FIG. 22 is an explanatory diagram showing a map for determining cylinders to be subjected to the stoppage of fuel injection from the number of cylinders to be subjected to fuel cut-off in the throttle control apparatus for an internal combustion engine according to the first embodiment of the present invention.

The internal combustion engine 1 of the present embodiment is a V-type 6-cylinder engine, as has already been mentioned. The order of ignition is set in the order of cylinder numbers or #1 to #6. However, cylinders to be subjected to fuel cut-off in FIG. 22 are not defined by a cylinder number but are defined such that a cylinder to be first subjected to fuel injection after the judgement as having failed is "1". Accordingly, for example, when the judgement as having failed is made at the point of time of completion of fuel injection to the #4 cylinder and the number of cylinders Nfc to be subjected to fuel cut-off is set to 3, the cylinders to be subjected to fuel cut-off are set as "1", "1" and "5" but the #5, #1 and #3 cylinders are actually subjected to be fuel cut-off since a cylinder to be next subjected to fuel injection is the #5 cylinder. It is of course that the cylinders to be subjected to fuel cut-off as shown in FIG. 22 is determined taking the balance of the internal combustion engine 1 into consideration.

As apparent from the foregoing, in the present embodiment, the internal combustion engine 1 functions as the internal combustion engine M1, the throttle valve 5 as the throttle valve M2 and the DC motor 31 as the electrical drive unit M3. Also, the accelerator interlocking mechanism 22 functions as the mechanical drive unit M5, the CPU 62 when performing the processes of steps S121 and S122 functions as the estimation unit M85, the CPU 62 when performing the processes of steps S123, S124 and S105 functions as the setting unit M84, and the injector driving circuit 65 and the injectors 7 function as the cessation cylinder control unit M82.

Further, in the present embodiment, the accelerator position sensor 47 functions as the accelerator return operation detection unit M9, and the CPU 62 when performing the processes of steps S103, S104, S114 and S115 functions as the complete operations unit M10.

Thus, the throttle control apparatus for an internal combustion engine of the present embodiment is provided with the DC motor 31 for controlling the throttle valve 5 of the internal combustion engine 1 for opening/closing on the basis of a predetermined opening angle characteristic in accordance with the amount of accelerator operation Ap detected by the accelerator position sensor 47, and the accelerator interlocking mechanism 22 for driving the throttle valve 5 for opening/closing on an opened side as compared with the DC motor 31 and in a mechanically interlocking manner with an accelerator operation. When an abnormality of a throttle control system is generated, a throttle control by the DC motor 31 is stopped and there instead the throttle valve 5 is driven for opening/closing by the accelerator interlocking mechanism 22. The throttle control apparatus is further provided with the CPU 62 for determining an upon-failure estimated torque Tfa from an upon-failure throttle opening angle Θsave and an engine rotation speed Ne and for determining an after-failure estimated torque Tap from the amount of accelerator operation Ap and the engine rotation speed Ne to determine an increase in torque ΔT before and after the judgement as having failed on the basis of both the estimated torques Tfa and Tap, thereby setting the number of cylinders Nfc of the internal combustion engine 1 to be subjected to fuel cut-off, and an injector driving circuit 65 and the injectors 7 for subjecting specified cylinders to fuel cut for cessation in accordance with the number Nfc of cylinders to be subjected to fuel cut which is set by the CPU 62.

Accordingly, when the abnormality of the throttle control system is generated, the number of cylinders Nfc to be subjected to fuel cut-off is set from the increase in torque ΔT before and after the judgement as having failed and the specified cylinders are subjected to fuel cut-off for cessation in accordance with the set number of cylinders Nfc to be subjected to fuel cut-off, so that an engine torque is decreased. Thus, an increase in engine torque against a driver's intention, when the throttle opening angle Θth is changed in the opening direction due to the stoppage of actuation of the DC motor 31, is surely suppressed. Therefore, the driver can continue running a vehicle without adjusting the amount of accelerator operation Ap again, thereby making it possible to greatly improve the feeling of throttle operation.

Also, the throttle control apparatus for an internal combustion engine of the present embodiment is provided with the accelerator position sensor 47 for detecting an accelerator return operation after the judgement as having failed and the CPU 62 for setting the number of cylinders Nfc to be subjected to fuel cut to 0 at the time of detection of the accelerator return operation by the accelerator position sensor 47 to carry out fuel-injection for all the cylinders.

Accordingly, after the accelerator return operation is performed subsequently to the judgement as having failed, an increase in oscillation resulting from cylinder cessation is prevented since fuel injection is made for all the cylinders. Therefore, it is possible to continue the travel of the vehicle without injuring the comfortableness of the driver and passengers carried.

In the above embodiment, the present invention is embodied as a throttle control apparatus in which an electrical throttle control by the DC motor 31 according to the predetermined opening angle characteristic and a mechanical opening/closing drive by the accelerator interlocking mechanism 22 in an interlocking manner with an accelerator operation are made by a single throttle valve 5. However, the embodiment of the present invention is not limited to such a throttle control apparatus. The present invention is applicable to any throttle control apparatus so long as an increase in engine torque, when an abnormality is generated in a throttle control system so that the throttle opening angle Θth is changed to the opened side by the stoppage of actuation of the DC motor 31, can be suppressed by operationally ceasing specified cylinders. Accordingly, the present invention can be embodied in, for example, a throttle control apparatus provided with a pair of throttle valves as shown in FIG. 23.

Figure 23:
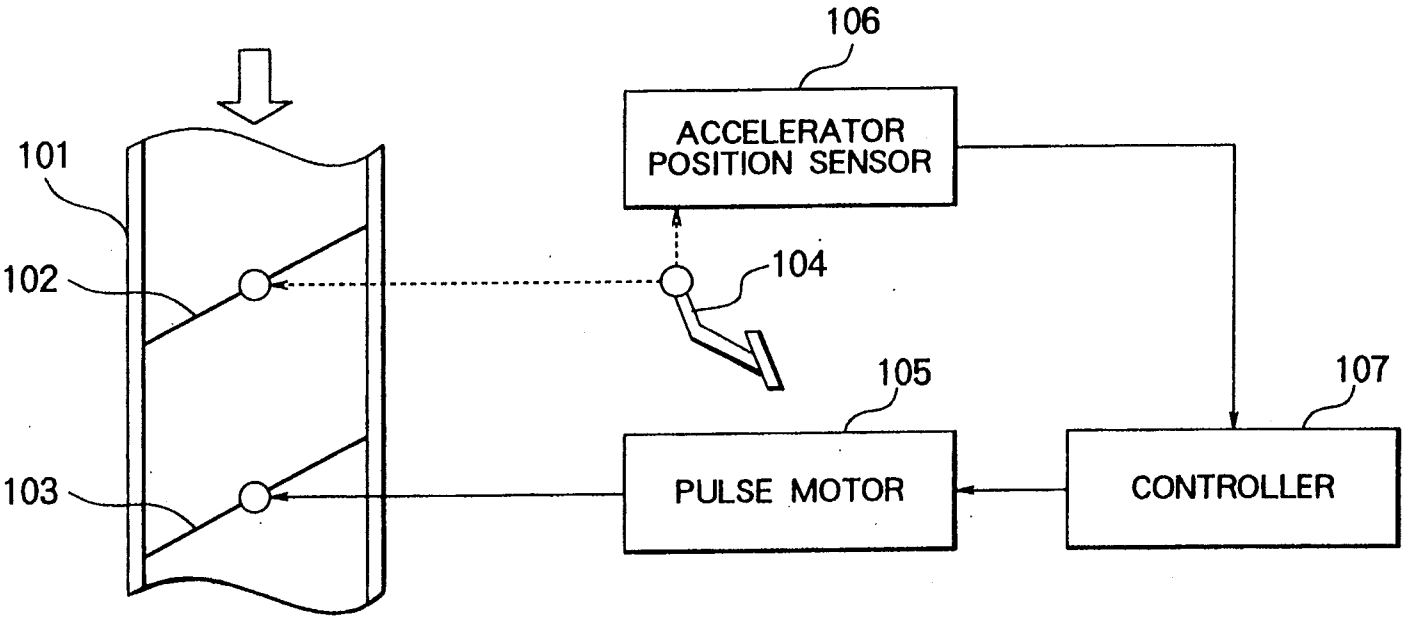
FIG. 23 is a schematic diagram showing the construction of another example of a throttle control apparatus for an internal combustion engine.

An example of a throttle control apparatus provided with a highly reliable countermeasure against the abnormality of a throttle control system is a throttle control apparatus shown by FIG. 23.

FIG. 23 is a schematic diagram showing the construction of an example of a throttle control apparatus for internal combustion engine. In this throttle control apparatus, a first throttle valve 102 and a second throttle valve 103 are in series in an intake path 101 for supplying an intake air to an internal combustion engine. The first throttle valve 102 is mechanically coupled to an accelerator pedal 104 so that the valve is driven for opening/closing in an interlocking manner with an accelerator operation. The second throttle valve 103 is driven for opening/closing by a pulse motor 105. The accelerator pedal 104 is provided with an accelerator position sensor 106 for detecting the amount of accelerator operation and a detection signal of the accelerator position sensor 106 is inputted to a controller 107. The controller 107 determines a throttle opening angle command value corresponding to the amount of accelerator operation in accordance with a preset opening angle characteristic to output a driving signal to the pulse motor 105, thereby controlling the actual opening angle of the second throttle valve 103 to the throttle opening angle command value.

The opening angle of the second throttle valve 103 is controlled by the pulse motor 105 so that it is positioned always on a closed side as compared with the opening angle of the first throttle valve 102. Therefore, the amount of intake air of the internal combustion engine at normal time is determined by the opening angle of the second throttle valve 103. Also, when an abnormality is generated in a throttle control system which controls the second throttle valve 103 for opening/closing, the controller 107 holds the second throttle valve 103 at a fully-opened condition by virtue of the pulse motor 105. Thus, the travel of a vehicle can be continued in such a manner that the amount of intake air at the time of generation of an abnormality is determined by the opening angle of the first throttle valve 102 and the first throttle valve 102 is opened/closed in accordance with an accelerator operation.

In the throttle control apparatus shown in FIG. 23, since the first throttle valve 102 is opened/closed in a mechanically interlocking manner with the accelerator pedal 104, it becomes possible to continuously perform a sure throttle operation without being affected by an abnormality of the throttle control system.

In the throttle control apparatus for internal combustion engine shown in FIG. 23, the opening angle of the second throttle valve 103 at normal time is controlled to be positioned on a closed side as compared with the opening angle of the first throttle valve 102, as mentioned above, the amount of intake air is substantially determined by the second throttle valve 103.

Therefore, when the second throttle valve 103 is opened with the generation of an abnormality of the throttle control system, the amount of intake air of the internal combustion engine is increased up to a value corresponding to the opening angle of the first throttle valve 102. Accordingly, through less as compared with the throttle control apparatuses disclosed by the JP-A-62-35039 and the "JP-A-60-159346, an increase in engine torque against an driver's intention is exhibited to give the sense of unfitness or uncomfortableness to the driver and hence the amount of operation of the accelerator pedal 104 must be adjusted again even thereafter, which is not preferable in respect of the feeling of accelerator operation.

In this case, when the second throttle valve 103 is held in a fully-opened condition with the generation of an abnormality, an increase in engine torque can be suppressed in such a manner that an increase in torque ΔT is determined from a difference between the opening angles of the first and second throttle valves 102 and 103 immediately before the generation of the abnormality and cylinders corresponding in number to the increase in torque ΔT are operationally ceased or put out of operation.

In the foregoing embodiment, the increase in torque ΔT is estimated from the amount of accelerator operation Ap, the throttle opening angle Θth and the engine rotation speed Ne. However, the amount of intake air Qa or an intake pipe pressure Pm may be used in lieu of those parameters to estimate the increase in torque ΔT Namely, the increase in torque ΔT in torque may be estimated on the assumption that the upon-failure estimated torque Tfa is equivalent to the amount of intake air Qa or the intake pipe pressure Pm at the time of generation of a failure and the after-failure estimated torque Tap is equivalent to the amount Qa of intake air or the intake pipe pressure Pm after the judgement as having failed.

In the above embodiment, the judgement of the throttle control system as having failed is made in the case where it is determined in the first throttle control system abnormality judgement routine that a certain degree of difference between the control estimated throttle opening angle ΘcmdO and the actual throttle opening angle Θth is continuously generated and in the case where it is determined in the second throttle control system abnormality judgement routine that a state with a difference between the guard position Θmg and the throttle opening angle Θth being decreased is continuously generated. However, the abnormality of the throttle control system in the present invention is not limited to those cases and includes all situations in which the throttle control by the DC motor 31 becomes incapable of being performed and the mechanical throttle control by the accelerator interlocking mechanism 22 is needed. Accordingly, for example, when a mechanical abnormality is generated in the motor drive mechanism 21, the throttle control system may be judged as having failed.

In the above embodiment, a normal throttle control for controlling the travel of a vehicle is performed by the DC motor 31. However, the present invention can be embodied without being limited to such a case or the contents of the throttle control are not restricted so long as the throttle valve 5 is electrically controlled for opening/closing. Accordingly, the present invention can be applied to, for example, a throttle control for traction control (hereinafter referred to simply as "TRC") such as a throttle control apparatus disclosed by JP[U]-A-2-37245. The throttle control apparatus disclosed by JP[U]-A-2-37245 is provided with a pair of throttle valves including one throttle valve or a main throttle valve which is controlled for opening/closing in a mechanically interlocking with an accelerator operation to provide a function of controlling the travel of a vehicle and the other throttle valve or an auxiliary throttle valve which is controlled to a closed side by the TRC at the time of generation of the slip of a driving wheel of the vehicle to provide a function of reducing an engine torque to suppress the slip. As disclosed by JP[U]-A-2-37245, when an abnormality is generated in a throttle control system during the TRC, the auxiliary throttle valve controlled to the closed side is held at a fully-opened condition in order to immediately stop the TRC. Therefore, the amount of intake air of an internal combustion engine is increased up to a value corresponding to the opening angle of the main throttle valve so that the engine torque is increased. A sudden increase in torque at this time can be suppressed by putting specified cylinders out of operation in accordance with the increase in engine torque in a manner similar to that in the above embodiment.

In the throttle control apparatus shown in FIG. 3, at the time of a cruise control travel, the guard lever 45 is rotationally operated in the opening direction by the diaphragm actuator 49 so that the throttle valve 5 is rotationally controlled by the DC motor 31 even if no accelerator operation is performed. The opening angle of the throttle valve during warm-up and after warm-up at idling is controlled by the thermowax 50 and the operating rod 50*a*.

Figure 24:
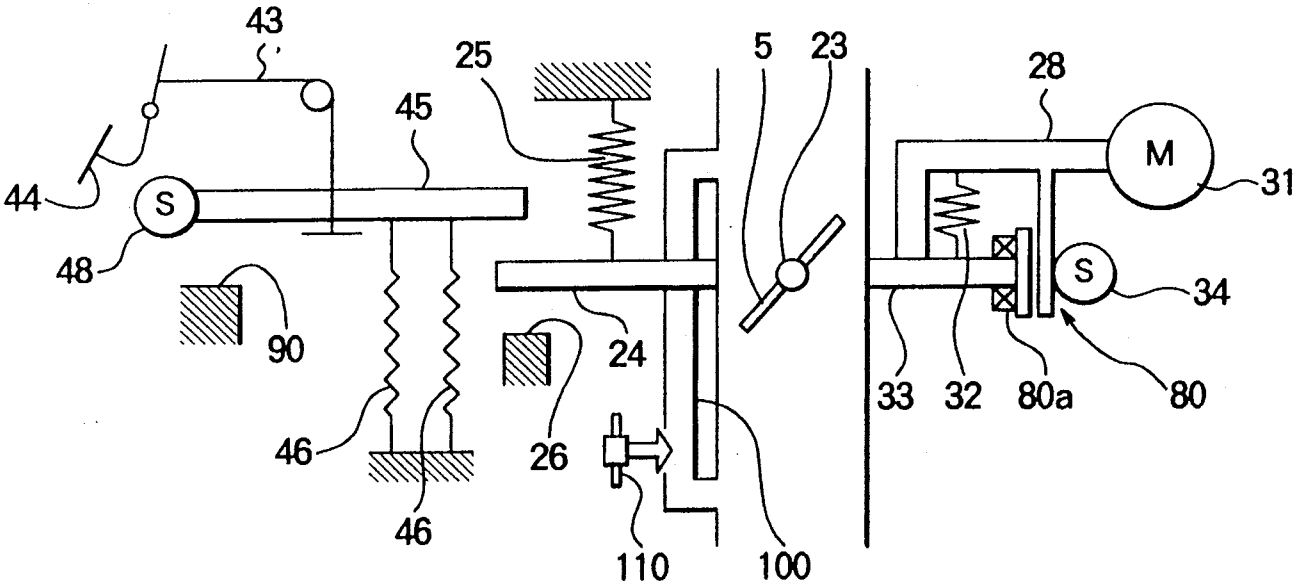
FIG. 24 is a schematic diagram for explaining the principle of operation of the periphery of a throttle valve to which a throttle control apparatus for an internal combustion engine according to another embodiment of the present invention is applied.

FIG. 24 shows another embodiment in which a normal control, a cruise control and an idling control are performed by an electromagnetic clutch or the like provided in lieu of the diaphragm actuator 49, the thermowax 50 and the operating rod 50*a*.

In FIG. 24, the construction of a throttle valve provided with an electromagnetic clutch is shown with a schematic illustration of the principle of operation of the periphery of a throttle valve as in FIG. 4. In FIG. 24, the upward direction is an opening direction of the throttle valve 5 and the downward direction is a closing direction thereof.

In the present embodiment shown in FIG. 24, the accelerator position sensor 47 in the embodiment shown in FIG. 3 is not provided and the amount of accelerator operation is detected by a guard position sensor 48. Also, a throttle opening angle sensor 34 is attached to a slave gear 28.

In the following, the operation of the throttle control apparatus shown in FIG. 24 will be explained.

At the time of a normal control, the supply of a current to a clutch coil 80*a* of an electromagnetic clutch 80 is cut-off. When an accelerator pedal 44 is operated, a signal Θmg corresponding to the amount of accelerator operation is output from the guard position sensor 48 and a DC motor 31 is driven on the basis of the signal Θmg. Thereupon, the slave gear 28 is rotated to a closed side or in the closing direction so that the throttle valve 5 is opened.

At the time of a cruise control, on the other hand, a current is supplied to the clutch coil 80*a* of the electromagnetic clutch 80 so that the slave gear 28 and a throttle shaft 23 are directly coupled. Thereby, the throttle valve 5 is controlled for opening/closing by the DC motor 31.

In the embodiment shown in FIG. 24, a guard stopper 90 is provided on the throttle valve 5 closing direction side of a guard lever 45 in order to control a further rotation of the throttle valve 5 in the closing direction. A throttle valve opening angle corresponding to the guard stopper 90 is set such that it takes a value somewhat larger than a throttle valve opening angle corresponding to a fully-closed position stopper 26 indicative of a fully-closed position of the throttle valve 5. Thereby, when the throttle valve 5 is at the fully-closed position and the guard lever 45 abuts against the guard stopper 90, a predetermined gap is formed between the guard lever 45 and the stopper lever 24. With such a construction, the control of the throttle valve 5 in an opening angle range between an opening angle corresponding to the fully-closed position and an opening angle corresponding to the position of the guard stopper 90 becomes enabled by the DC motor 31 during idling. Even in the case where the load of the internal combustion engine 1 involves variations, the idle rotation speed can be kept constant by controlling the DC motor 31.

Further, in the present embodiment, a by-path 100 for bypassing the throttle valve 5 and an air valve 110 for controlling the opening/closing of the by-path 100 are provided. The air valve 110 is opened when the engine is cold to increase the amount of bypass air and is closed after the completion of warm-up to decrease the amount of bypass air. After warm-up, the throttle valve 5 is controlled by the DC motor 31 in the predetermined gap mentioned above.

In a throttle control apparatus in which the above-mentioned by-path 100 is not provided and hence the idle rotation speed is controlled by the throttle valve 5 even when the engine is cold, there may be an inconvenience in that even after warm-up, the throttle valve 5 remains opened at an angle larger than an opening angle corresponding to a desired idle rotation speed due to a failure of the DC motor 31, the controller 61 or the like, thereby causing an abnormal increase in engine rotation speed. However, the provision of the by-path 100 overcomes such an inconvenience.

In the throttle control apparatus, too, various failure judgements mentioned in the embodiment shown in FIG. 3 are made. When it is determined that the abnormality of a throttle control system or a valve lock is generated, a fail safe process corresponding to this abnormality is performed in a manner similar to the embodiment shown in FIG. 3 and the control for the number of cylinders and the operation of estimated torques are performed.

However, in the electromagnetic clutch 80 shown in FIG. 24, there is the case where a clutch lock is generated that when the clutch coil 80*a* is turned from a current flow condition into a non-current flow condition, the clutch is not released surely so that the coupling between the throttle valve 5 and the slave gear 42 is not released.

Therefore, when the clutch lock as mentioned above is generated, there is a need to detect surely this abnormality.

Figure 25:
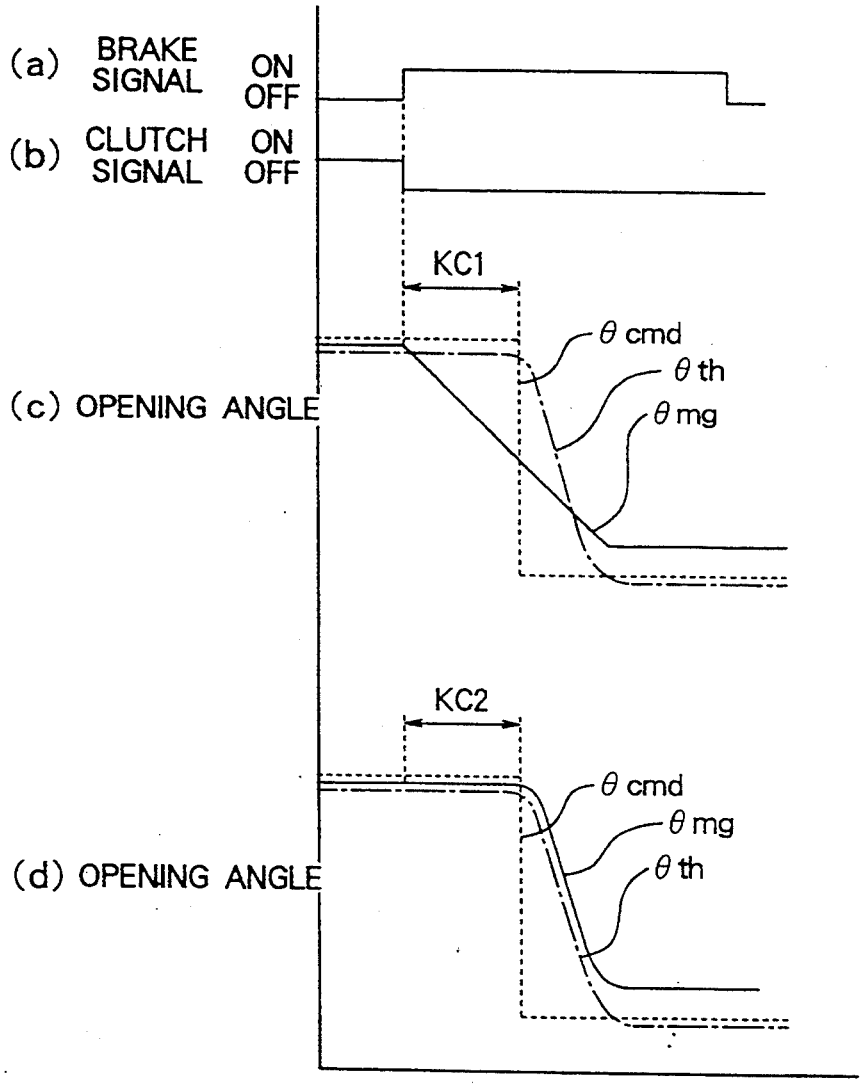
FIG. 25 is a time chart of each signal at the time of release from a cruise control.

A clutch lock detection process will now be explained. The clutch lock detection process is performed at the time of release from cruise control. At the time of cruise control, when a brake is pushed, that is, when a brake signal is turned on as shown in waveform (a) of FIG. 25, a clutch signal to the clutch coil 80*a* is turned off (see waveform (b) of FIG. 25) so that a coupled state between the slave gear 28 and the throttle valve 5 by the electromagnetic clutch 80 is released. Since the amount of accelerator push can be considered to be zero substantially when the brake is pushed, the guard lever 45, a stopper lever 24, the throttle shaft 23 and so on are rotated in the closing direction by the energizing force of springs 46. Accordingly, an output value Θmg of the guard position sensor 48 nears a value corresponding to the position of the guard stopper 90, as shown by solid line in waveform (c) of FIG. 25. Thus, at the time of release from cruise control, in order to hold the slave gear 28 at a position at that time for a predetermined time KC1, a throttle opening angle command value Θcmd is output to the DC motor 31 as shown by broken line in waveform (c) of FIG. 25 so that the slave gear 28 also assumes the position of a fully closed position stopper 26 after the predetermined time. Thereupon, if the clutch is released surely, the slave gear 28 takes the position of the fully-closed position stopper 26 after the predetermined time mentioned above and an output value Θth of the throttle opening angle sensor 34 attached to the slave gear 28 exhibits one-dotted line in waveform (c) of FIG. 25.

On the other hand, if a clutch lock is generated, the guard lever 45, the stopper lever 24, the throttle shaft 23 and so on are held at positions as they are, even after the release from cruise control. When the slave gear 28 is rotated in the closing direction after the predetermined time, the guard lever 45, the stopper lever 24, the throttle shaft 23 and so on are correspondingly rotated so that Θmg coincides with Θcmd, as shown by solid line in waveform (d) of FIG. 25.

Accordingly, the presence/absence of generation of a clutch lock can be judged by holding the slave gear 28 by the DC motor 31 for a predetermined time and detecting Θmg and Θcmd at this time.

In the following, a clutch lock detection process at the time of release from cruise control will be explained by virtue of a flow chart shown in FIG. 26. This clutch lock detection process is incorporated as one of a plurality of failure judgement processes in the failure judgement process routine of FIG. 6 performed at step S1 of the throttle control routine of FIG. 5 in the embodiment shown in FIG. 3.

Figure 26:
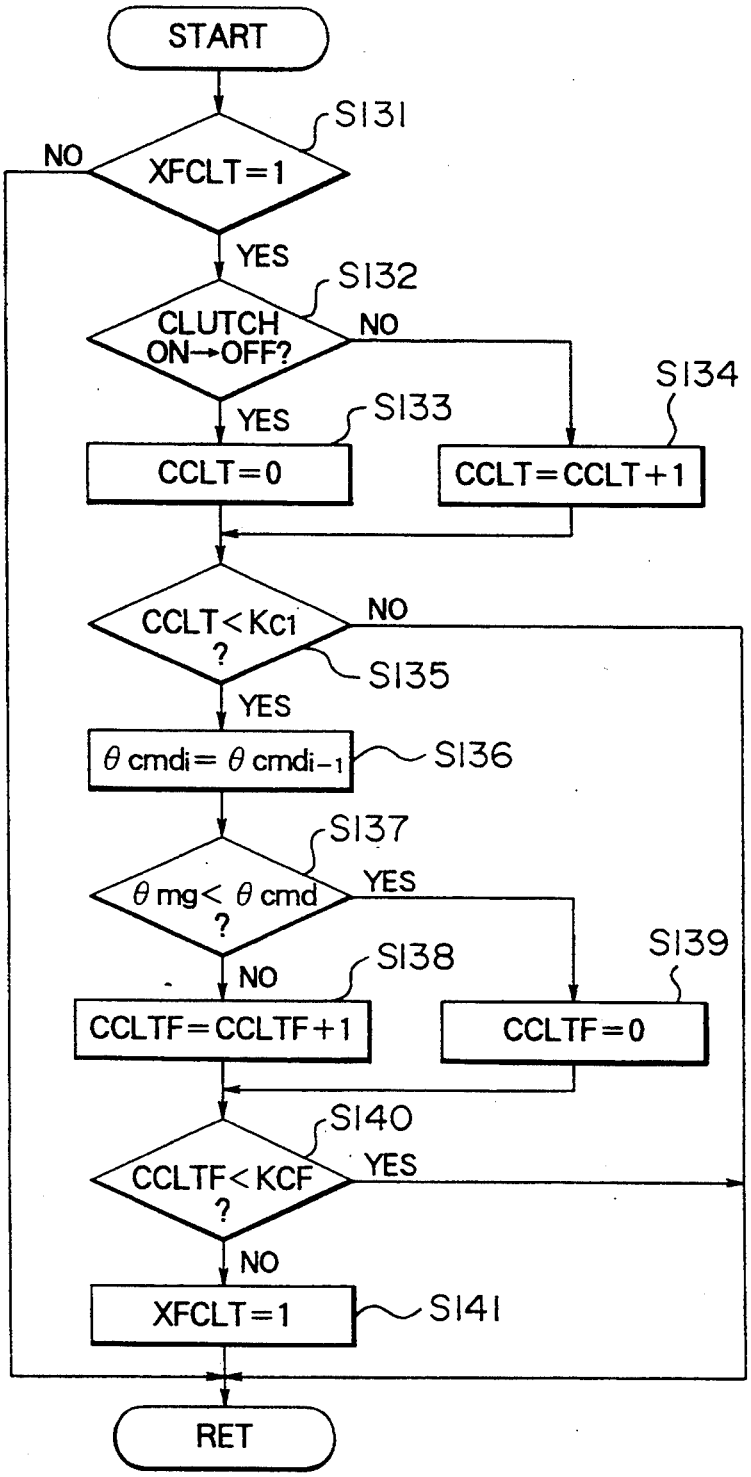
FIG. 26 is a flow chart showing a clutch lock detection routine.

When a clutch lock detection routine is called in the failure judgement routine shown in FIG. 6, the flow turns to step S131 shown in FIG. 26.

In step S131, the judgement is made as to whether or not a clutch lock judgement flag XFCLT indicative of the generation of a clutch lock has already been set. If the judgement flag XFCLT has been set, the clutch lock detection process is completed immediately.

On the other hand, if it is determined in step 101 that the judgement flag XFCLT has not been set, the flow goes to step S132. In steps S132 to S136, processes are performed in which Θcmd is closed with a delay of a predetermined time KC1 from the time of release from a cruise control.

Namely, in step S132, the judgement is made as to whether a clutch signal is turned from ON to OFF so that release from cruise control is made. If the judgement in step S132 is such that the clutch signal is turned from ON to OFF, a counter CCLT is set to 1 in step S133. If the judgement in step S132 is not so, the counter CCLT is incremented in step S134 (CCLT=CCLT+1). Thereby, the counter CCLT is counted up from the point of time when the clutch signal is turned from ON to OFF.

In step S135, the judgement is made as to whether or not the count value of the counter CCLT is smaller than the predetermined time KC1. If the count value CCLT is smaller than KC1, the flow goes to step S136. If the case is not so, the clutch lock detection process is completed.

When the count value CCLT is smaller than KC1, that is, when the predetermined time KC1 is not reached after release from cruise control, the present command value Θcmdi is made to be the same as the last command value Θcmdi−1 (step S136). Then, the flow goes to step S137 in which the judgement is made as to whether or not Θmg is smaller than Θcmd. If Θmg is smaller than Θcmd, the flow goes to step S139. If the case is not so, the flow goes to step S138. In step 5138, a counter CCLTF is incremented (CCLTF=CCLTF+1). Then, the flow goes to step S140. On the other hand, in step S139, the counter CCLTF is set to 0. Then, the flow goes to step S140. Thereby, it is possible to detect how long a state, in which the value of Θmg and the value of Θcmd are the same as the result of generation of a clutch lock, is continued.

In step S140, the judgement is made as to whether or not the counter CCLTF is smaller than a predetermined time KCF. When it is determined that the counter CCLTF is smaller than the predetermined time KCF, the clutch lock detection process is completed immediately. When this is not the case is not so, the clutch lock judgement flag XFCLT is set in step S141, thereby completing the clutch lock detection process.

When the clutch lock detection process is completed, the flow returns to the throttle control routine shown in FIG. 5. At this time, if the clutch lock judgement flag XFCLT has been set, the flow goes to steps S2, S6, S7 and S9 so that the warning lamp is lit and the actuation of the DC motor 31 is stopped. On the other hand, if the clutch lock judgement flag XFCLT has not been set, the flow goes to steps S2, S3, S4 and S5 so that a throttle opening angle command value Θcmd at the time of a normal throttle control is set and Θcmd is converted into Vcmd which is in turn output.

Thereby, a clutch lock of the electromagnetic clutch 80 can be judged at the time of release from cruise control.

Figure 27:
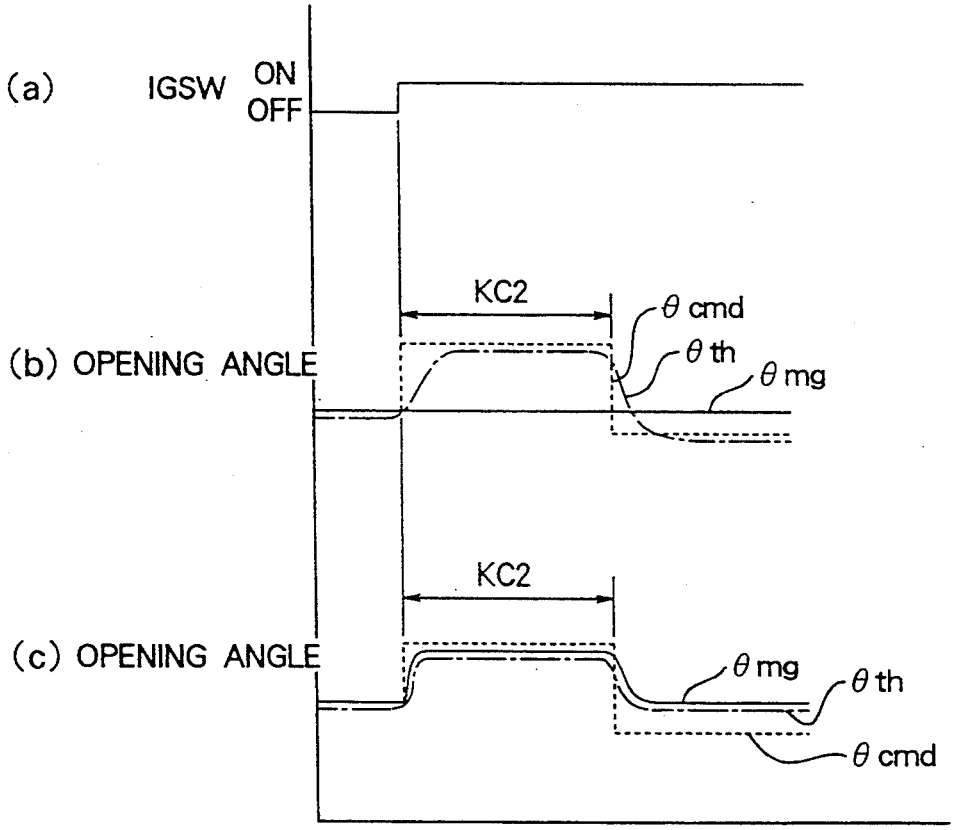

The detection of a clutch lock of the electromagnetic clutch 80 may be made not at the time of release from cruise control as mentioned above when the engine is started, that is, when an ignition switch (hereinafter referred to as IGSW) is turned on. Namely, when the IGSW is turned on, as shown in waveform (a) of FIG. 27, an output value Θcmd to the DC motor 31 is set to a value (KMG) with which the throttle valve 5 takes a position opened by a predetermined angle (for example, +5°) as compared with the position of the guard stopper 90 and this value is held for a predetermined time KC2 (see waveforms (b) and (c) of FIG. 27). During this period of time, Θmg is compared with Θcmd. If a clutch lock is not generated, Θmg is smaller than Θcmd as shown in waveform (b) of FIG. 27 since the throttle valve 5 is at the position of the guard stopper 90. On the other hand, if a clutch lock is generated, Θmg becomes equal to Θcmd, as shown in waveform (c) of FIG. 27. When the state of Θmg=Θcmd is continued for a predetermined time (KCF), the judgement as having been locked is made.

Figure 28:
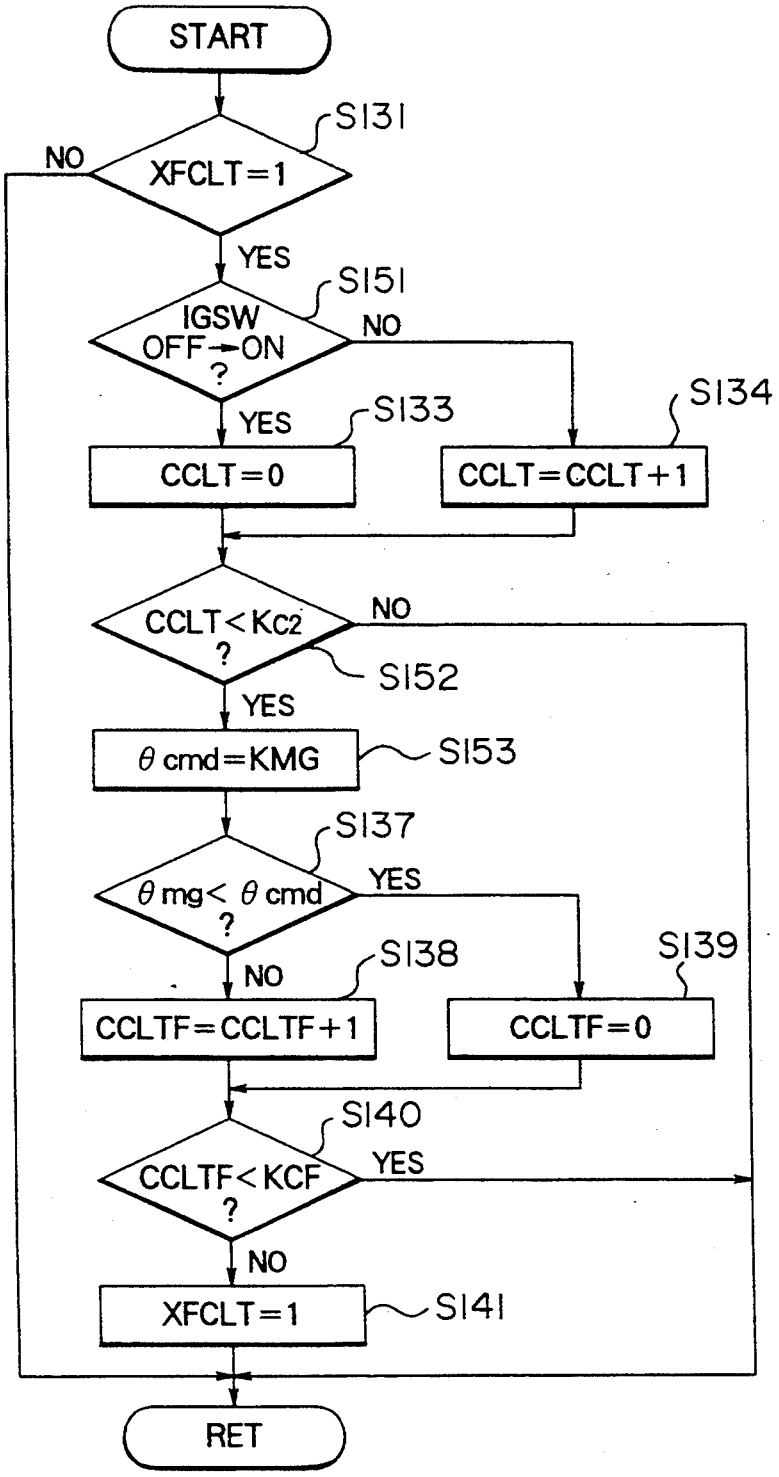
FIG. 28 is a flow chart showing a clutch lock detection routine.

A clutch lock detection process based on the above process is shown in FIG. 28.

The process shown in FIG. 28 is substantially the same as that shown in FIG. 26. Since the same steps in FIG. 28 as those in FIG. 26 are designated by the same reference numerals as those used in FIG. 26, explanation thereof will be omitted.

In step S151, the judgement is made as to whether or not the IGSW is turned from OFF to ON. If it is determined that the IGSW is turned from OFF to ON, the flow goes to step S133. If this is not the case, the flow goes to step S134. Thereby, a counter CCLT is counted up from the point in time when the LGSW is turned to ON.

In step 152, the judgement is made as to whether or not the count value of the counter CCLT is smaller than a predetermined time KC2. If the count value CCLT is smaller than FC2, the flow goes to step S153. If this is not the case, this clutch lock detection process is completed. In step S153, Θcmd is held as the above-mentioned value KMG.

Next, Θmg is compared with Θcmd (=KMG) in step S138. Thereby, it is possible to detect whether or not a clutch lock is generated.

Also, the clutch lock detection process shown in FIG. 28 may be performed at the time of the start of deceleration fuel cut-off which is performed normally, when the accelerator pedal is at a fully-opened position and an engine rotation speed is not lower than a predetermined rotation speed. This is because at the time of deceleration fuel cut-off, the behavior of the engine is not affected, however drive of the throttle valve 5 is.

Figure 29:
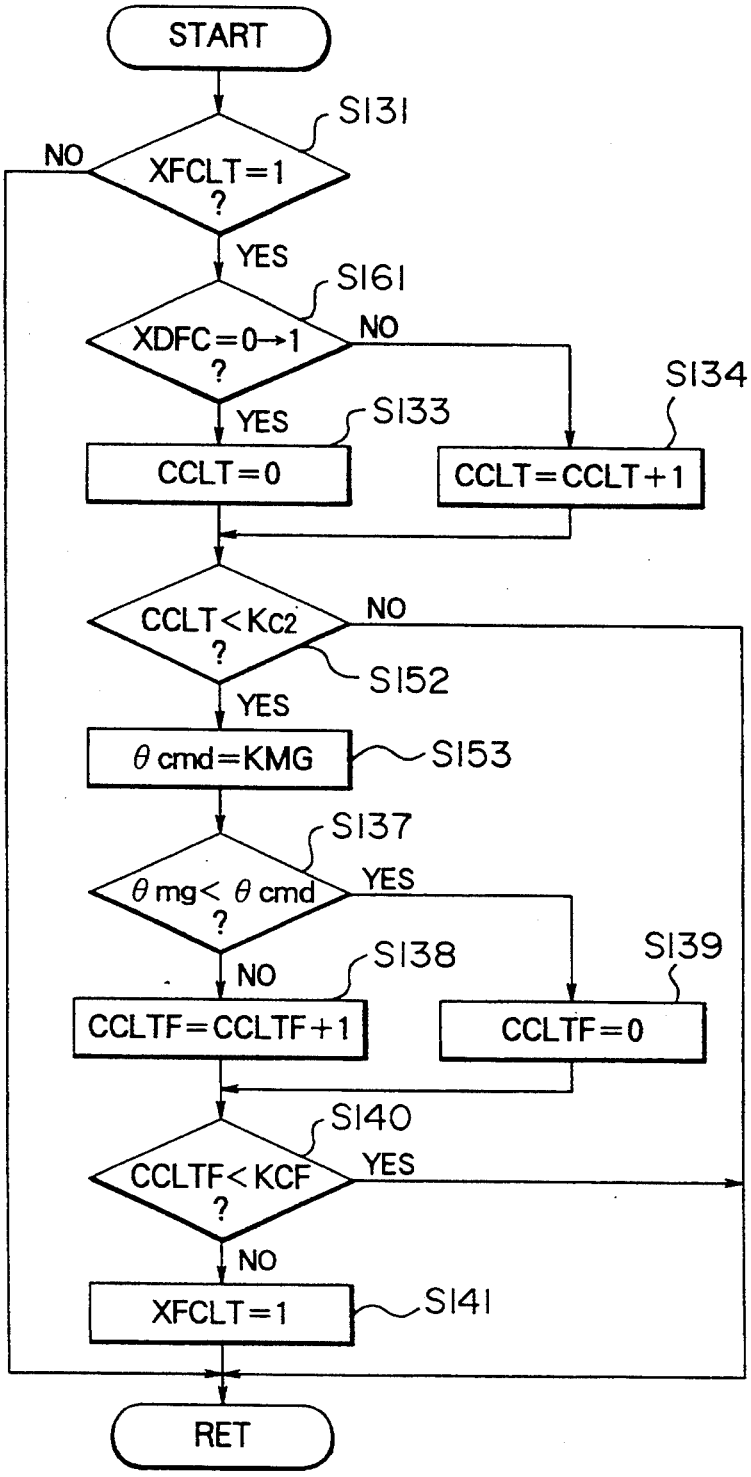
FIG. 29 is a flow chart showing a clutch lock detection routine.

A clutch lock detection process at the time of deceleration fuel cut-off is shown in FIG. 29. The process shown in FIG. 29 is substantially the same as that shown in FIG. 28, but for step S161. Therefore, explanation of the other processes will be omitted.

In step S161, the judgement is made as to whether or not a deceleration fuel cut-off flag XDFC is set from 0 to 1. The flag XDFC is such that it is set, at a normal time, when the accelerator pedal is at the fully-opened position and the engine rotation speed is a predetermined rotation speed (for example, 1500 rpm). If it is determined that KDFC is set, the flow goes to step S133. If this is not the case, a counter CCLT is incremented in step S134 (CCLT=CCLT+1). Thereby, the counter CCLT is counted up from the point in time when the deceleration fuel cut-off is carried out. In step S153, Θcmd is held as the above-mentioned value KMG. In step S137, Θmg is compared with Θcmd (=KMG), thereby making it possible to detect whether or not a clutch lock is generated.

As apparent from the foregoing, in a throttle control apparatus for an internal combustion engine according to the present invention, when an abnormality is generated in a throttle control system, specified cylinders of an internal combustion engine are operationally ceased in accordance with an increase in engine torque. Accordingly, an increase in engine torque against a driver's intention is suppressed surely when a throttle opening angle is changed to an opened side with the generation of the abnormality. Therefore, the driver can continue running the vehicle without adjusting the amount of accelerator operation again, thereby making it possible to improve greatly the feeling of throttle operation.

Further, in the throttle control apparatus for an internal combustion engine according to the present invention, when an accelerator return operation by the driver is performed after the generation of the abnormality of the throttle control system, all cylinders of the internal combustion engine are operated. Therefore, it is possible to prevent an increase in oscillation resulting from the cessation of the operation of specified cylinders since fuel injection is made for all the cylinders, thereby continuing the travel of the vehicle without degrading the comfort of the driver and passengers carried.

Figure 30:
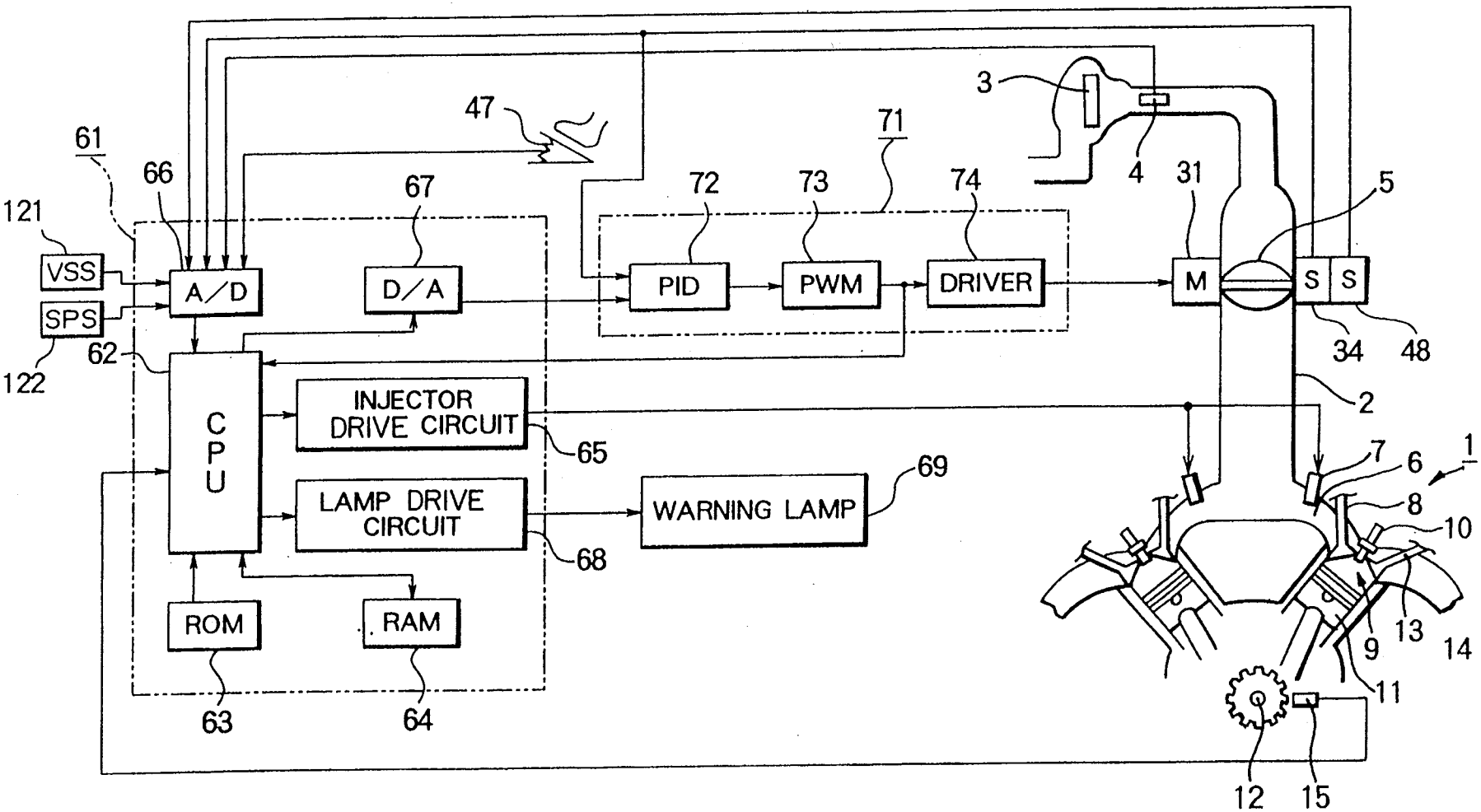
FIG. 30 is a diagram schematically showing the construction of a throttle control apparatus for an internal combustion engine according to a further embodiment of the present invention.

According to a further embodiment of the present invention, the number of cylinders Nfc to be subjected to fuel cut-off may be set on the basis of a vehicle speed or an engine rotation speed. FIG. 30 is a schematic diagram showing the construction of this embodiment. In FIG. 30, a vehicle speed sensor 121 and a shaft position sensor 122 are provided in addition to the construction shown in FIG. 2. Since the other construction shown in FIG. 30 is similar to the construction shown in FIG. 2, explanation thereof will be omitted.

Figure 31:
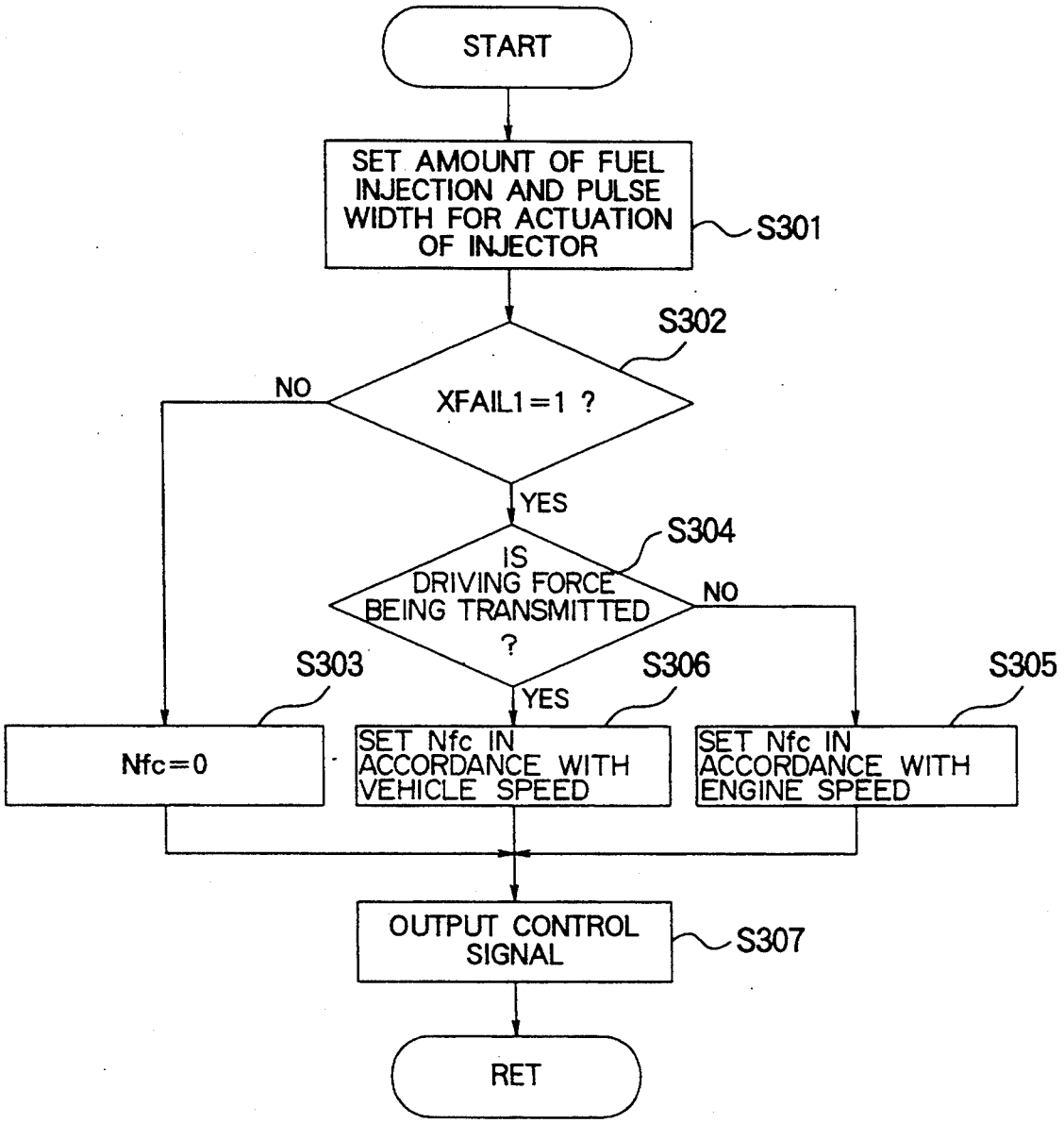
FIG. 31 is a flow chart showing a process performed by a CPU of the throttle control apparatus for an internal combustion engine according to the embodiment shown in FIG. 30.

The embodiment shown in FIG. 30 will be explained with reference to FIG. 31 which shows a flow chart of a process performed by the CPU 62. In this flow chart, a failure flag XFAIL1 is set to "0" as an initialization process when an IGSW is turned on. Also, the routine of the shown flow chart is performed at every 720° in terms of a crank angle of the internal combustion engine 1.

After the initialization process has been performed, the CPU 62 determines the amount of fuel injection presently requested by the internal combustion engine 1 from the amount of intake air Qa detected by the air flow meter 4 and the an engine rotation speed Ne detected by the crank angle sensor 15 and sets a pulse width corresponding to the determined amount of fuel injection (step S301). Next, the judgement is made as to whether or not the failure flag XFAIL1 is "1" (step S302). If the failure flag XFAIL1 is not "1", the flow goes to step S303 in which the number of cylinders Nfc to be subjected to fuel cut-off is set to "0" and thereafter goes to step S307. If it is determined in step S302 that the failure flag XFAIL1 is "1", the flow goes to step S304. In step S304, the judgement is made as to whether or not a driving force of the engine is being transmitted to a wheel. More particularly, the judgement is made from a detection signal of the shift position sensor 122 such that the judgement in the case of an automatic transmission (ΔT) vehicle is made as to whether a shifted position of a gear is made at a drive position or a reverse position and the judgement in the case of a manual transmission (MT) vehicle is made as to whether or not the transmission is shifted to a gear position and a clutch is engaged. When it is determined in step S304 that the driving force is being transmitted to the wheel, the flow goes to step S306. When the driving force is not being transmitted to the wheel, the flow goes to step S305.

Figure 32:
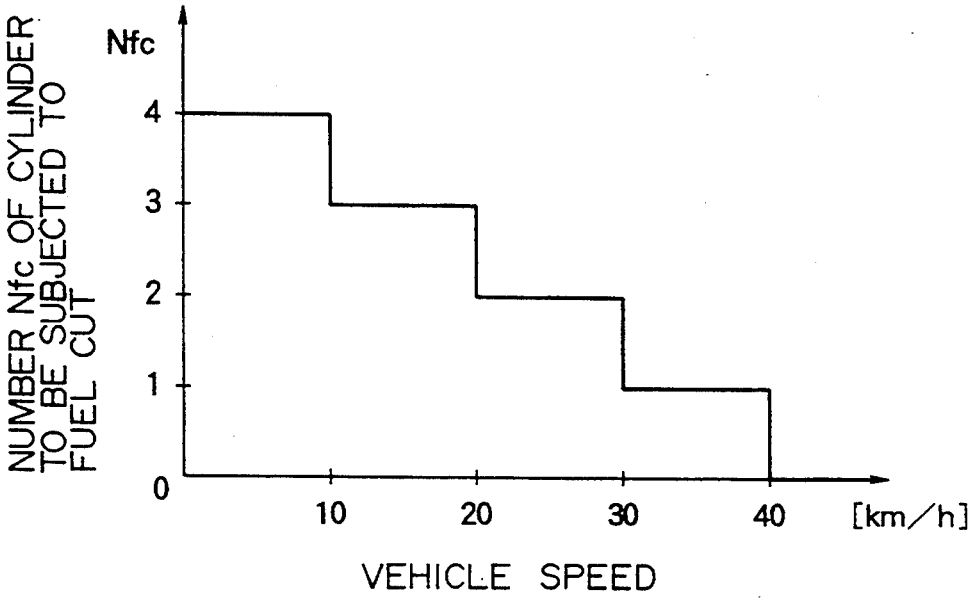
FIG. 32 is an explanatory diagram showing a map for determining the number of cylinders to be subjected to fuel cut-off on the basis of a vehicle speed in the throttle control apparatus for an internal combustion engine according to the embodiment shown in FIG. 30.

In step S306, the number of cylinders Nfc to be subjected to fuel cut corresponding to a vehicle speed detected by the vehicle speed sensor 121 is set from a map shown in FIG. 32. Namely, as the vehicle speed becomes slow, the number of cylinders Nfc to be subjected to fuel cut-off is increased. In step S305, the number of cylinders Nfc to be subjected to fuel cut-off is set from a map shown in FIG. 33. Namely, as the engine rotation speed becomes high, the number of cylinders Nfc to be subjected to fuel cut-off is increased. After the number of cylinders Nfc to be subjected to fuel cut-off has been set in step S305 or S306, a control signal having the pulse width set in step S301 and for cylinders corresponding to the number of cylinders Nfc to be subjected to fuel cut-off is outputted to the injector drive circuit 65 (step S307). As a result, injectors 7 corresponding in number to the number of cylinders Nfc to be subjected to fuel cut-off are actuated for fuel injection so that the corresponding cylinders are operated.

With the above process performed, the number of cylinders Nfc to be subjected to fuel cut-off is set corresponding to the vehicle speed when the driving force is being transmitted to the wheel. More particularly, as the vehicle speed becomes slow, the number of cylinders Nfc to be subjected to fuel cut-off is increased. Thereby, when the vehicle is at a standstill, the number of cylinders Nfc to be subjected to fuel cut-off is made large to suppress a torque, thereby preventing an abrupt start of the vehicle. Also, since the number of cylinders Nfc to be subjected to fuel cut-off is set such that it is decreased as the vehicle speed becomes fast, deterioration of the drivability is also prevented.

Also, when the driving force is not being transmitted to the wheel, the number of cylinders Nfc to be subjected to fuel cut-off is set corresponding to the engine rotation speed. More particularly, as the engine rotation speed becomes high, the number of cylinders Nfc to be subjected to fuel cut-off is increased. Thereby, it is possible to prevent an increase in engine rotation speed when the driving force of the engine is not being transmitted to the wheel, for example, in a state in which the gear is shifted at a neutral position. Also, it is possible to prevent excess engine rotation when the engine is in a neutral position which might produce anxiety in the driver.

When a failure is once detected, the above process continues until the IGSW is turned off. And, when the IGSW is next turned on, the failure flag XFAIL1 is reset to "0". Therefore, if a normal condition returns, a fuel normal injection process is performed. If the abnormal condition is continued, the failure flag XFAIL1 is set to "1"again so that fuel cut-off is carried out to perform the corresponding fuel injection process.

Figure 33:
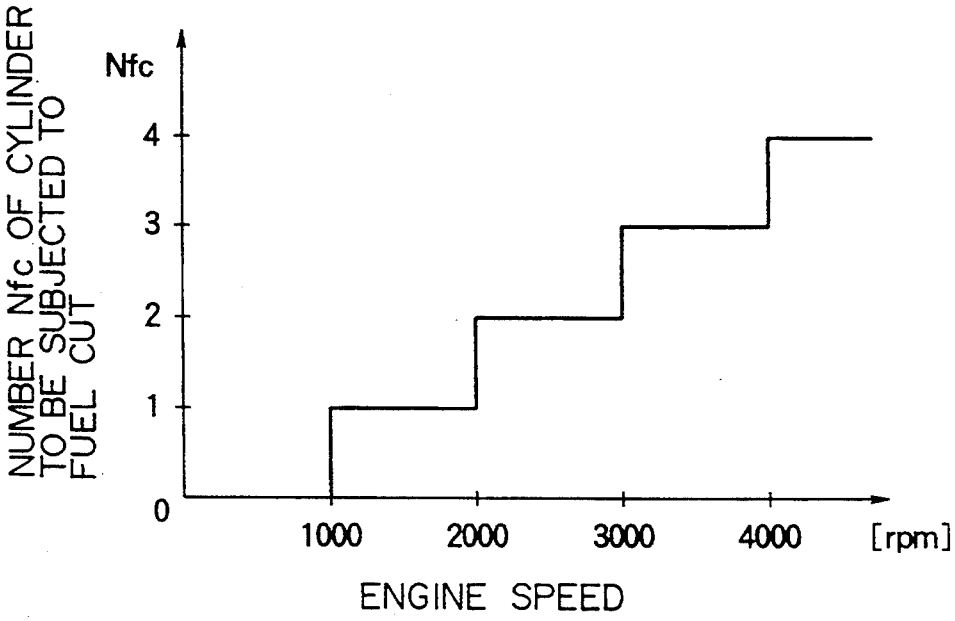
FIG. 33 is an explanatory diagram showing a map for determining cylinders to be subjected to the cessation of fuel injection from the number of cylinders to be subjected to fuel cut-off on the basis of an engine rotation speed in the throttle control apparatus for an internal combustion engine according to the embodiment shown in FIG. 30.

In the present embodiment, the condition of changeover of the number of cylinders Nfc to be subjected to fuel cut-off as shown in FIG. 32 or 33 may be provided with a hysteresis characteristic.

What is claimed is:

1. A throttle control apparatus for an internal combustion engine provided with electrical drive means for electrically driving a throttle of an internal combustion engine and mechanical drive means for driving said throttle in a mechanically interlocking manner with an accelerator operated by a driver, comprising:

an opening angle control member, forming a part of said mechanical drive means, positioned on an opened side of said throttle and restricting an opened angle of said throttle as adjusted by said electrical drive means, said opening angle control member being moved in an interlocking manner with said accelerator to control said opened angle of said throttle;

abnormality detection means for detecting an abnormality of said electrical drive means to interrupt said driving of said throttle by said electrical drive means; and torque control means for suppressing an increase in an output torque of said internal combustion engine when said opened angle of said throttle is increased from an opened angle defined by said electrical drive means to an opened angle defined by said opening angle control means when said driving of said throttle by said electrical drive means is interrupted by said abnormality detection means.

2. A throttle control apparatus for an internal combustion engine according to claim 1, further comprising:

accelerator return operation detecting means for detecting a return operation of said accelerator to a closed position after said abnormality of said electrical drive means is detected; and complete operations means for causing a completion of said suppression of said increase in torque by said torque control means when said accelerator return operation is detected by said accelerator return operation detecting means.

3. A throttle control apparatus for an internal combustion engine according to claim 1, wherein said torque control means includes cessation cylinder control means for temporarily ceasing combustion of a cylinder of said internal combustion engine.

4. A throttle control apparatus for an internal combustion engine according to claim 3, wherein:

said torque control means further includes cessation cylinder number setting means for setting said number of cylinders from among all cylinders of said internal combustion engine to be subjected to combustion cessation in accordance with an increase in torque before and after the detection of said abnormality of said electrical drive means; and said cessation cylinder control means controls cylinders of said internal combustion engine to be subjected to said combustion cessation in accordance with said number of cylinders to be subjected to said combustion cessation set by said cessation cylinder number setting means.

5. A throttle control apparatus for an internal combustion engine according to claim 4, wherein said cessation cylinder control means includes:

engine torque estimating means for estimating a first engine torque at a time of said detection of said abnormality of said electrical drive means, and a second engine torque set by said opening angle control member after said detection of said abnormality of said electrical drive means; and setting means for determining a projected increase in torque before and after said detection of said abnormality of said electrical drive means on a basis of said first engine torque and said second engine torque estimated by said engine torque estimating means to set said number of cylinders to be subjected to said combustion cessation to cancel said projected increase in torque.

6. A throttle control apparatus for an internal combustion engine according to claim 5, wherein said engine torque estimating means includes:

first estimation means for estimating said first engine torque on a basis of said opened angle of said throttle and a rotation speed of said internal combustion engine at said time of detection of said abnormality of said electrical drive means; and second estimation means for estimating said second engine torque on a basis of an amount of operation of said accelerator and said rotation speed of said internal combustion engine after said detection of said abnormality of said electrical drive means.

7. A throttle control apparatus for an internal combustion engine according to claim 3, wherein said cessation cylinder control means includes means for stopping a supply of fuel to a cylinder of said internal combustion engine to be subjected to said combustion cessation.

8. A throttle control apparatus for an internal combustion engine according to claim 1, further comprising opening direction energizing means for assisting said accelerator in opening said throttle.

9. A throttle control apparatus for an internal combustion engine according to claim 8, wherein said electrical drive means includes:

a first member which interlocks with said throttle;

a second member positioned on an opening direction side of said first member; and an actuator for driving said second member in said opened and in a closed direction.

10. A throttle control apparatus for an internal combustion engine according to claim 8, wherein said mechanical drive means further includes a second member which interlocks with said throttle, wherein said opening angle control member is positioned on an opening direction side of said third member.

11. A throttle control apparatus for an internal combustion engine according to claim 8, wherein said mechanical drive means further includes closing direction energizing means for overcoming said assistance of said opening direction energizing means provided to said accelerator with an energizing force stronger than that of said assistance and thus energizing said opening angle control means in a closed direction.

12. A throttle control apparatus for an internal combustion engine according to claim 8, wherein said electrical drive means includes;

a first member which interlocks with said throttle;

an actuator; and a clutch provided between said first member and said actuator for intermitting a mechanical connection between said actuator and said first member;

said actuator driving said throttle in said opened direction and in a closed direction in a state in which said clutch is connected.

13. A throttle control apparatus for an internal combustion engine according to claim 12, wherein said mechanical drive means further includes:

closing direction energizing means for energizing said opening angle control means in a closed direction by an energizing force stronger than an opposite energizing force of said opening direction energizing means;

said actuator driving said throttle against said closing direction energizing means in said opened direction and in said closed direction in said state in which said clutch is connected.

14. A throttle control apparatus for an internal combustion engine according to claim 1, wherein said abnormality detection means includes:

estimating means for determining an estimated value of a present throttle opening angle;

a throttle sensor for detecting an actual throttle opening angle; and means for outputting an abnormality signal when a difference between said estimated value and said actual opening angle exceeds a predetermined value.

15. A throttle control apparatus for an internal combustion engine according to claim 14, wherein said means for outputting said abnormality signal outputs said abnormality signal only when said difference exceeds said predetermined value for a predetermined period of time.

16. A throttle control apparatus for an internal combustion engine according to claim 1, wherein said abnormality detection means includes:

means for detecting a controlled throttle opening angle controlled by said opening angle control means;

a throttle sensor for detecting an actual throttle opening angle; and means for outputting an abnormality signal when a difference between said controlled throttle opening angle and said actual throttle opening angle is smaller than a predetermined value.

17. A throttle control apparatus for an internal combustion engine according to claim 16, wherein said means for outputting said abnormality signal outputs said abnormality signal only when said difference remains smaller than said predetermined value for a predetermined period of time.

18. A throttle control apparatus for an internal combustion engine according to claim 1, wherein said abnormality detection means includes:

means for detecting a controlled throttle opening angle controlled by said opening angle control means;

an accelerator sensor for detecting an actual amount of operation of said accelerator; and means for outputting an abnormality signal when a difference between said controlled throttle opening angle and said amount of operation of said accelerator exceeds a predetermined value.

19. A throttle control apparatus for an internal combustion engine according to claim 18, wherein said means for outputting said abnormality signal outputs said abnormality signal when said difference exceeds said predetermined value for a predetermined period of time.

20. A throttle control apparatus for an internal combustion engine according to claim 1, wherein:

said electrical drive means comprises motor means for driving said throttle;

said apparatus further comprises an idle control circuit for providing an idle opening angle control signal to said motor means to maintain an idling throttle opening angle at a predetermined value; and said abnormality detection means includes:

means for judging whether or not said idle opening angle control signal in said idle control circuit is smaller than a predetermined reference value, and means for outputting an abnormality signal when said idle opening angle control signal is smaller than said predetermined reference value.

21. A throttle control apparatus for an internal combustion engine according to claim 1, wherein:

said electrical drive means comprises motor means for driving said throttle;

said apparatus further comprises a throttle control circuit for supplying an opening angle command signal to said motor means to control a throttle opening angle to a command value; and said abnormality detection means includes means for judging whether or not said opening angle command signal is smaller than a predetermined reference value and means for outputting the judgement as an abnormality signal when said opening angle command signal is smaller than said predetermined reference value for a predetermined period of time.

22. A throttle control apparatus for adjusting an opening angle of a throttle of an internal combustion engine to adjust an output torque of said internal combustion engine, comprising:

an accelerator operated by a driver;

opening direction energizing means for energizing said throttle in an opening direction;

an opening angle control member which is positioned on an opened direction side of said throttle and is moved in a mechanically interlocking manner with said accelerator so that said opening angle control member abuts against said member interlocking with said throttle to drive said throttle against said opening direction energizing means in a closing direction;

electrical drive means for electrically driving said throttle within a range of a closing direction side of said throttle;

abnormality detection means for detecting an abnormality of said electrical drive means to interrupt said driving of said throttle by said electrical drive means; and torque control means for suppressing an increase in output torque of said internal combustion engine when said opening angle of said throttle is increased from a first opening angle defined by said electrical drive means to a second opening angle defined by said opening angle control means said driving of said throttle by said electrical drive means is interrupted.

23. A throttle control apparatus for an internal combustion engine according to claim 22, further comprising:

accelerator return operation detecting means for detecting a return operation of said accelerator to a closed position after said abnormality of said electrical drive means is detected; and complete operations means for causing a completion of said suppression of said increase in torque by said torque control means when said accelerator return operation is detected by said accelerator return operation detecting means.

24. A throttle control apparatus for an internal combustion engine according to claim 22, wherein said electrical drive means includes:

a first member which interlocks with said throttle;

a second member positioned on an opening direction side of said first member; and an actuator for driving said second member in said opening direction and in said closing direction.

25. A throttle control apparatus for an internal combustion engine according to claim 22, wherein said mechanical drive means further includes closing direction energizing means for energizing said opening angle control means in a closing direction by an energizing force stronger than an energizing force of said opening direction energizing means.

26. A throttle control apparatus for an internal combustion engine according to claim 22, wherein said electrical drive means includes:

a first member which interlocks with said throttle;

an actuator; and a clutch provided between said first member and said actuator for intermitting a mechanical connection between said actuator and said first member;

said actuator driving said throttle in said opening direction and in said closing direction in a state in which said clutch is connected.

27. A throttle control apparatus for an internal combustion engine according to claim 26, wherein said mechanical drive means further includes:

closing direction energizing means for energizing said opening angle control means in said closing direction by an energizing force stronger than an energizing force of said opening direction energizing means;

said actuator driving said throttle against said closing direction energizing means in said opening direction and in said closing direction in said state in which said clutch is connected.

28. A throttle control apparatus for an internal combustion engine for driving a drive wheel of a vehicle, comprising:

throttle driving means for controlling an opening angle of a throttle valve of said internal combustion engine on a basis of a predetermined throttle opening angle command value;

accelerator interlocking means for driving said throttle valve for opening/closing in a mechanically interlocking manner with an accelerator operation on an opened side of said throttle;

throttle control stopping means for stopping said control of said throttle by said throttle driving means at a time of detection of an abnormality of a throttle control system so that said throttle is opened and closed by said accelerator interlocking means;

cessation cylinder number setting means for setting a number of cylinders from among all cylinders of said internal combustion engine to be subjected to operational cessation at said time of detection of said abnormality on a basis of a torque generated in said driving wheel so that said number of cylinders to be subjected to operational cessation becomes large as said torque is increased; and cessation cylinder control means for ceasing an operation of specified ones of said cylinders at said time of detection of said abnormality of said throttle control system and corresponding to said number of cylinders to be subjected to operational cessation set by said cessation cylinder number setting means.

29. A throttle control apparatus for an internal combustion engine according to claim 28, wherein said cessation cylinder number setting means includes means for setting said number of cylinders to be subjected to operational cessation so that said number of cylinders to be subjected to operational cessation becomes large as a speed of said vehicle becomes slow.

30. A throttle control apparatus for an internal combustion engine according to claim 29, further comprising:

torque transmission judging means for judging whether or not a torque generated in said internal combustion engine is transmitted to said driving wheel;

said cessation cylinder number setting means further including means for setting said number of cylinders to be subjected to operational cessation, when said torque transmission judging means determines that said torque generated in said internal combustion engine is not transmitted to said driving wheel, so that said number of cylinders to be subjected to operational cessation becomes large as a speed of said internal combustion engine becomes high.

* * * * *